US007268327B2

(12) United States Patent
Yamamoto et al.

(10) Patent No.: US 7,268,327 B2
(45) Date of Patent: Sep. 11, 2007

(54) INDUCTION HEATING APPARATUS WITH MAGNETIC FLUX ADJUSTING MEANS

(75) Inventors: Naoyuki Yamamoto, Toride (JP); Takahiro Nakase, Toride (JP); Hitoshi Suzuki, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/255,035

(22) Filed: Oct. 21, 2005

(65) Prior Publication Data

US 2006/0086726 A1 Apr. 27, 2006

(30) Foreign Application Priority Data

Oct. 22, 2004 (JP) ..... 2004-308502

(51) Int. Cl.
*H05B 6/14* (2006.01)
*G03G 15/20* (2006.01)

(52) U.S. Cl. ..... 219/619; 219/670; 219/663; 399/328; 399/330

(58) Field of Classification Search ..... 219/619, 219/670, 660–667; 399/328–338
See application file for complete search history.

(56) References Cited

U.S. PATENT DOCUMENTS

| | | | | |
|---|---|---|---|---|
| 5,534,987 | A | 7/1996 | Ohtsuka et al. | 355/285 |
| 6,373,036 | B2 | 4/2002 | Suzuki | 219/619 |
| 6,713,734 | B2 | 3/2004 | Suzuki | 219/619 |
| 6,782,216 | B2 | 8/2004 | Suzuki | 399/69 |
| 6,969,833 | B2 | 11/2005 | Suzuki | 219/619 |
| 6,970,664 | B2 | 11/2005 | Yamamoto | 399/69 |
| 7,038,178 | B2 | 5/2006 | Suzuki | 219/619 |
| 7,122,769 | B2 | 10/2006 | Nami et al. | 219/619 |
| 7,132,631 | B2 | 11/2006 | Nami et al. | 219/619 |
| 2004/0253027 | A1* | 12/2004 | Kato et al. | 399/328 |
| 2005/0173415 | A1 | 8/2005 | Yamamoto et al | 219/619 |
| 2005/0252912 | A1 | 11/2005 | Yamamoto | 219/619 |
| 2006/0086719 | A1 | 4/2006 | Suzuki et al. | 219/619 |
| 2006/0086720 | A1 | 4/2006 | Nakase et al. | 129/619 |
| 2006/0086724 | A1 | 4/2006 | Yamamoto et al. | 219/619 |
| 2006/0086726 | A1 | 4/2006 | Yamamoto et al. | 219/619 |
| 2006/0086730 | A1 | 4/2006 | Kondo et al. | 219/645 |
| 2006/0088327 | A1 | 4/2006 | Nakase et al. | 399/69 |
| 2006/0088328 | A1 | 4/2006 | Yoshimura et al. | 399/69 |

FOREIGN PATENT DOCUMENTS

| | | |
|---|---|---|
| JP | 9-171889 | 6/1997 |
| JP | 10-74009 | 3/1998 |

* cited by examiner

*Primary Examiner*—Philip H. Leung
(74) *Attorney, Agent, or Firm*—Fitzpatrick, Cella, Harper & Scinto

(57) ABSTRACT

A heating apparatus has an induction heat generation member for electromagnetic induction heat generation by the magnetic flux at a heating portion, wherein a material to be heated is introduced to the heating portion and is fed in direct contact with the induction heat generation member or in contact to a heat transfer material for receiving heat from the induction heat generation member; a magnetic flux adjusting unit for changing a distribution of a density of an effective magnetic flux actable on the induction heat generation member with respect to a widthwise direction perpendicular to a feeding direction of the material to be heated; wherein magnetic flux adjusting unit has a plurality of steps which extend in the feeding direction and are selectable to change the distribution of the magnetic flux density in response to a width of the material measured in the widthwise direction, wherein a step of the steps for a largest magnetic flux adjustment region measured in the widthwise direction is largest.

8 Claims, 12 Drawing Sheets

(a) LARGE SIZE (RETRACTED POS.)

(b) MIDDLE SIZE (FIRST STEP POSITION)

(c) SMALL SIZE (SECOND STEP POSITION)

(a) LARGE SIZE (RETRACTED POS.)

(b) MIDDLE SIZE (FIRST STEP POSITION)

(c) SMALL SIZE (SECOND STEP POSITION)

INDUCTION HEATING APPARATUS WITH MAGNETIC FLUX ADJUSTING MEANS

FIELD OF THE INVENTION AND RELATED ART

The present invention relates to a heating apparatus employing a heat generating method based on electromagnetic induction, and an image forming apparatus employing such a heating apparatus.

To describe it in more detail, the present invention relates to a heating apparatus which employs a heat generating method based on electromagnetic induction, and is ideal as a fixing apparatus for thermally fixing an image (pre-fixation image) formed, directly or indirectly, on an object to be heated, of a thermally meltable substance (or substances). Here, "indirectly" means "formed on a primary image bearing member and transferred onto an object to be heated". The present invention also relates to an image forming apparatus employing such a heating apparatus as a fixing means.

An electrophotographic image forming apparatus such as a copying machine, a printer, etc., is provided with a heating apparatus as a thermal fixing apparatus, which fixes (welds) an image (pre-fixation image) formed of toner (which hereinafter may be referred to as toner image) transferred onto a recording medium, as an object to be heated, which is being conveyed through the heating (fixing) apparatus, by applying heat and pressure to the recording medium and pre-fixation image, with the use of a heat applying rotatable member (fixation roller) and a pressure applying rotatable member (pressure roller).

A thermal fixing apparatus of the abovementioned type will have no problem, when a recording medium bearing a pre-fixation toner image and to be conveyed through the nip between the heat applying rotatable member and pressure applying rotatable member of a thermal fixing apparatus to fix the pre-fixation toner image onto the recording medium, is equal in dimension, in terms of the lengthwise direction of the rotatable members, to the rotatable members, that is, when the recording medium is of the largest size usable with the thermal fixing apparatus. However, if a certain number of recording mediums of the size smaller than the largest size are consecutively conveyed through the nip, a thermal fixing apparatus of the abovementioned type suffers from the following problem: The portions of each rotatable member, which correspond in position to the areas through which a recording medium is not conveyed (which hereinafter may be referred to simply "non-conveyance areas"), increases in temperature beyond the target level, causing thereby the difference in temperature between the portion of each rotatable member, which corresponds in position to the path of a recording medium (which hereinafter may be referred to simply as "conveyance area"), and the portions of the rotatable member corresponding to the abovementioned non-conveyance areas, to become substantial (extremely large).

Therefore, it is possible that such nonuniformity, in temperature, of the rotatable member as the heating member, in term of the lengthwise direction of the rotatable member, will reduce the service lives of the structural components formed of resinous substances and disposed adjacent to the rotatable member, and/or will thermally damage them. Moreover, a thermal fixing apparatus of the abovementioned type also suffers from the following problem: When a recording medium (mediums) of the maximum size compatible with the fixing apparatus is conveyed through the fixing apparatus immediately after a certain number of recording mediums of a size small than the maximum size are consecutively conveyed through the fixing apparatus, the recording medium (mediums) of the maximum size will suffer from such fixation anomalies that the local nonuniformity in the temperature of the rotatable member causes the recording medium to wrinkle, and/or become askew.

As for the extent of the above described temperature difference between the portion of the rotatable member corresponding to the sheet conveyance area and the portions of the rotatable member corresponding to the non-conveyance areas, the greater the thermal capacity of a recording medium being conveyed, and the higher the throughput (number of prints yielded per unit of time), the greater the temperature difference.

Japanese Laid-open Patent Application 10-74009 and Japanese Laid-open Patent Application 9-171889 propose heating apparatuses of the electromagnetic induction type, which do not suffer from the above described problems. These heating apparatuses comprises: a heat generating member in which heat is generated by electromagnetic induction: a magnetic flux generating means; a magnetic flux adjusting means disposed between the heat generating member and magnetic flux generating member to partially block the magnetic flux emitted from the magnetic flux generating means toward the heat generating member; and a magnetic flux adjusting means moving means for changing the position of the magnetic flux adjusting means.

As for the operational principle of these heating apparatuses, in order to control the heat generating member in terms of the size of the portion in which heat is generated, the magnetic flux adjusting means is moved into a position in which it blocks the unwanted portions of the magnetic flux emitted toward the heat generating member from the magnetic flux generating member, so that the heat generating member of the electromagnetic induction type is controlled in thermal distribution.

FIG. 13 shows the structure of the heating apparatus disclosed in Japanese Laid-open Patent Application 10-74009. The magnetic flux adjusting means 201 is shaped like one of the two halves that result as a cylinder is diagonally cut, and is disposed so that the exciting coil 502 as a part of the magnetic flux generating means is covered mainly across the top half thereof. When a recording medium Pa of a size smaller than that of the largest recording medium usable with the heating apparatus is conveyed through the nip N between the fixation roller 503 as a member in which heat is generated by electromagnetic induction, and the pressure roller 504 as a pressure applying rotatable member, this magnetic flux adjusting means 501 is moved by an unshown moving means (motor) into the position in which it covers the exciting coil 502 across the portions which correspond in position, in terms of the direction parallel to the axial direction of the fixation roller 503, to the portions of the fixation roller 503, which correspond in position to the aforementioned non-conveyance areas.

On the other hand, when a recording medium Pb of a larger size is conveyed through the nip N, the magnetic flux adjusting means 501 is retracted out of the area which corresponds in position to the path of the recording medium of the larger size.

In other words, the magnetic flux adjusting means 501 is changed in position by the moving means according to the size and position of the portion of the fixation roller 503, which corresponds in position to the aforementioned recording medium conveyance area. Therefore, the heating apparatus is capable of dealing with multiple types of a recording medium different in size.

In particular, a heating apparatus, in which a thin magnetic flux adjusting means 510 is shaped as shown in FIG. 14(A) or 14(B), is structured so that the magnetic flux adjusting means 510 can be moved in the axial direction thereof to change the magnetic flux adjusting means 510, in the size of the surface area by which the fixation roller 503 is covered with the magnetic flux adjusting means 510, and also, so that the holder 511 which supports the magnetic flux adjusting means 510 can be rotated. Therefore, the area across which the fixation roller 503 is shielded from the magnetic flux can be varied in size by rotating the holder 511, making it possible to control the heat distribution of the fixation roller 503, in spite of the limited space available for moving the magnetic flux adjusting means 510.

SUMMARY OF THE INVENTION

In the case of a conventional heating apparatus such as the above described ones, however, when the recording mediums (medium) to be conveyed through the heating apparatus are small, the magnetic flux adjusting means is moved into the position in which it covers the exciting coil, across the portions corresponding to the portions of the fixation roller corresponding to the non-conveyance areas, by driving a motor as the magnetic flux adjusting means moving means, whereas when the recording mediums (medium) to be conveyed through the heating apparatus are large, the magnetic flux adjusting means is retracted by driving the motor, that is, moved out of the area corresponding to the path of the large recording mediums, in terms of the lengthwise direction of the nip, that is, the direction perpendicular to the recording medium conveyance direction. Therefore, a conventional heating apparatus requires a apace dedicated to the retraction of the magnetic flux adjusting means; in other words, the heating apparatus needs to be increased in size in terms of the axial direction of the fixation roller, creating thereby the problem that the apparatus must be increased in size.

On other hand, in the case of a conventional heating apparatus, shown in FIG. 14, in which the thin magnetic flux adjusting means is made up of multiple sections different in width in terms of the direction perpendicular to the axial direction of the fixation roller, so that the portions of the fixation roller, which the magnetic flux adjusting means shields from the magnetic flux, can be varied in size by rotating the magnetic flux adjusting means, it requires only a very small amount (limited amount) of space to control the heat distribution of the fixation roller. However, in the case of a conventional heating apparatus structured as shown in FIG. 14, the magnetic flux adjusting means is always in the adjacencies of the fixation roller, regardless of recording medium size. Therefore, eddy current is induced even in the magnetic flux adjusting means, generating heat in the magnetic flux adjusting means itself, increasing therefore the temperature of the exciting coil beyond the temperature range which the exciting coil can withstand, which makes it possible for such problems to occur that the exciting coil is deteriorated by the heat, and/or the wires of the exciting coil are broken.

As for the amount of heat generated in the magnetic flux adjusting means itself, the larger the portions of the fixation roller to be shielded by the magnetic flux adjusting means from the magnetic flux, the larger the portions of the magnetic flux adjusting means which shield the portions of the fixation roller to be shielded, and therefore, the amount of the heat generated in the magnetic flux adjusting means itself. Therefore, the amount of heat generated in the magnetic flux adjusting means itself is largest (self heating of magnetic flux adjusting means is most conspicuous) when recording mediums of a small size are consecutively conveyed through the heating apparatus.

The present invention was made in consideration of the above described problems, and its primary object is to provide a heating apparatus which does not require the increase in the size of an image forming apparatus by which it is employed, does not wastefully generate heat in its member in which heat is to be generated, and does not cause the areas outside the path of an object to be heated, to increase in temperature, and which is characterized in that heat is not generated in its magnetic flux adjusting means itself, and to provide an image forming apparatus employing such a heating apparatus as a fixing means.

According to an aspect of the present invention, there is provided a heating apparatus of an electromagnetic induction type comprising magnetic flux generating means for generating a magnetic flux; an induction heat generation member for electromagnetic induction heat generation by the magnetic flux at a heating portion; wherein a material to be heated is introduced to the heating portion and is fed in direct contact with said induction heat generation member or in contact to a heat transfer material for receiving heat from said induction heat generation member so that material to be heated is heated by the heat from said induction heat generation member; magnetic flux adjusting means for changing a distribution of a density of an effective magnetic flux actable on said induction heat generation member with respect to a widthwise direction perpendicular to a feeding direction of the material to be heated; wherein magnetic flux adjusting means has a plurality of steps which extend in the feeding direction and are selectable to change the distribution of the magnetic flux density in response to a width of the material measured in the widthwise direction, wherein a step of the steps for a largest magnetic flux adjustment region measured in the widthwise direction is largest.

Thus, according the present invention, the magnetic flux adjusting means of a heating apparatus is capable of selecting one of multiple choices of magnetic flux density distribution, according to the dimension of an object to be heated, in terms of the direction perpendicular to the direction in which the object is conveyed. Therefore, when heating a larger object, the magnetic flux adjusting means does not need to be moved in the direction (width direction) perpendicular to the direction in which the object is conveyed. Also according to the present invention, the dimension of the step between the magnetic flux adjusting portion of the magnetic flux adjusting means, which corresponds to a smallest object heatable by the heating apparatus, and the magnetic flux adjusting portion of the magnetic flux adjusting means, which corresponds to a second smallest object heatable by the heating apparatus, is rendered largest. Therefore, the amount of heat generated in the magnetic flux adjusting means itself of a heating apparatus in accordance with the present invention while smallest objects heatable are consecutively heated is substantially smaller than the amount of heat generated in the magnetic flux adjusting means itself of a heating apparatus in accordance with any of the prior arts while smallest objects heatable are consecutively heated. Thus, the present invention makes it possible to prevent a heating apparatus from increasing in temperature, in the areas outside the path of an object to be heated, without changing the apparatus size and wastefully generating heat in the heating member by electromagnetic induction.

These and other objects, features, and advantages of the present invention will become more apparent upon consideration of the following description of the preferred embodiments of the present invention, taken in conjunction with the accompanying drawings.

DESCRIPTION Or THE PREFERRED EMBODIMENTS

Hereinafter, the preferred embodiments of the present invention will be described with reference to the appended drawings.

Embodiment 1

(1) Example of Image Forming Apparatus

Figure 1:
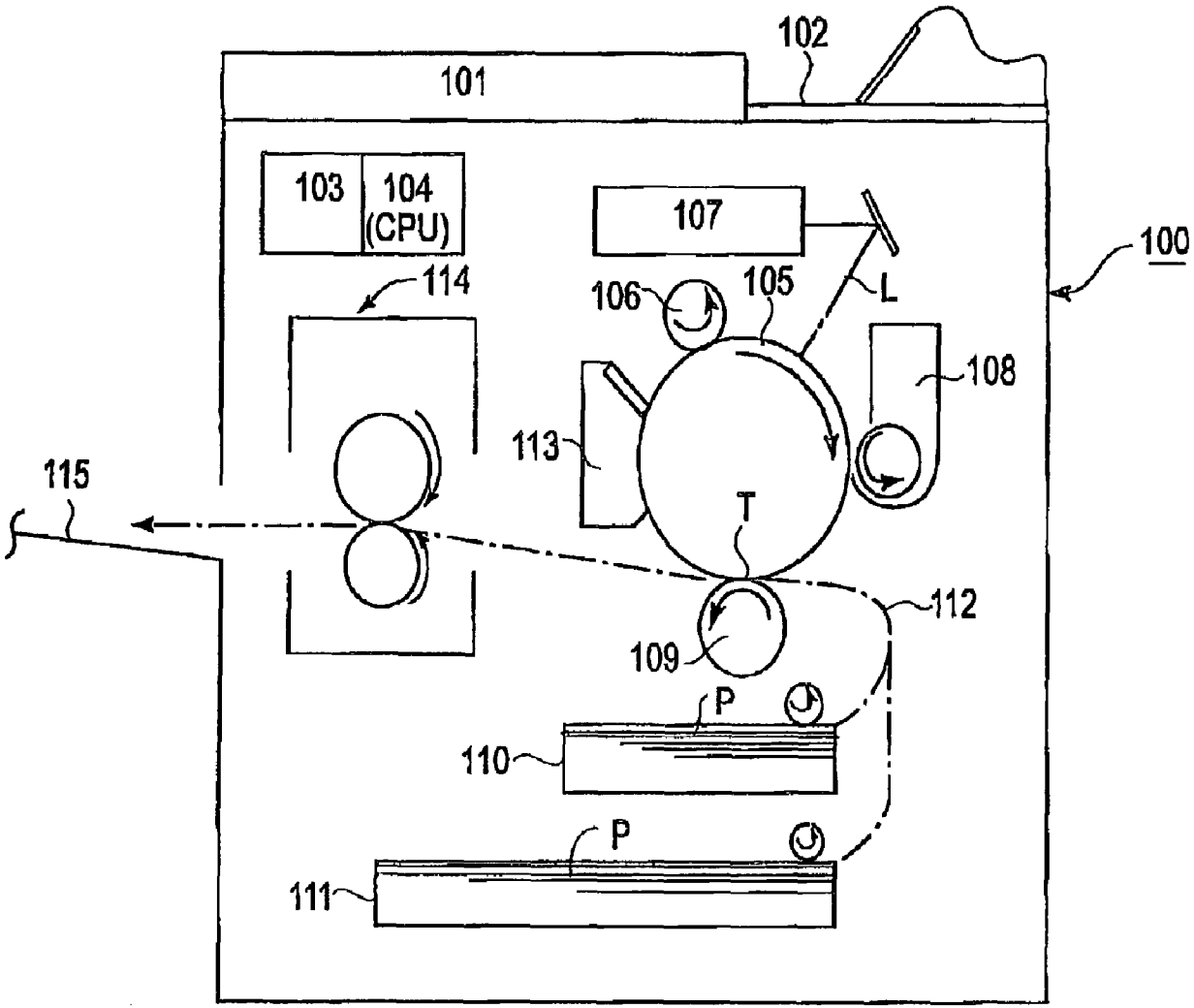
FIG. 1 is a schematic drawing of a typical image forming apparatus, showing the general structure thereof.

FIG. 1 is a schematic drawing of a typical image forming apparatus employing a heating apparatus, as a thermal image fixing apparatus, in accordance with the present invention, which uses the heating method based on electromagnetic induction, showing the general structure thereof. This example of image forming apparatus 100 is a digital image forming apparatus (copying apparatus, printer, facsimileing machine, multifunctional image forming apparatus capable of performing the functions of two or more of preceding examples of image forming apparatuses, etc.) of the transfer type, which uses the electrophotographic process and the exposing method based on laser based scanning.

Designated by referential symbols 101 and 102 are an original reading apparatus (image scanner) and an area designating apparatus (digitizer), respectively, which constitute the top portions of the main assembly of the image forming apparatus 100. The image scanner 101 comprises: an original placement platen; an optical system for illuminating and scanning an original, which has a light source, etc.; a light sensor such as a CCD line sensor; etc. In operation, the surface of an original placed on the original placement platen is scanned by the optical system to read the light reflected by the surface of the original, by the light sensor, and the thus obtained data of the original are converted into sequential digital electrical signals which correspond to picture elements. The area designating apparatus 102 sets the area of the original, which is to be read, etc., and outputs signals. Designated by a referential symbol 103 is a print controller, which outputs print signals based on the image formation data from a personal computer (unshown) or the like. Designated by a referential symbol 104 is a control portion (CPU) which processes the signals from the image scanner 101, area designating apparatus 102, print controller 103, etc., and sends commands to various portions of the image outputting mechanism and fixing apparatus 114. The control portion 104 also controls various image formation sequences.

Described next will be the image outputting mechanism. A referential symbol 105 designates an electrophotographic photosensitive member, as an image bearing member, in the form of a rotatable drum (which hereinafter will be referred to simply as photosensitive drum), which is rotationally driven in the clockwise direction indicated by an arrow mark at a predetermined peripheral velocity. As the photosensitive drum 105 is rotated, it is uniformly charged to predetermined polarity and potential level by a charging apparatus 106. The uniformly charged peripheral surface of the photosensitive drum 105 is exposed to a beam of image formation light L projected by an image writing apparatus 107. As the uniformly charged peripheral surface of the photosensitive drum 105 is exposed, numerous exposed points of the uniformly charged peripheral surface of the photosensitive drum 105 reduce in potential level. As a result, an electrostatic latent image, which matches the exposure pattern, is effected on the peripheral surface of the photosensitive drum 105. The image writing apparatus 107 of this example of image forming apparatus is a laser scanner, which outputs a beam of laser light L while modulating it with image formation signals which the control portion 104 (CPU) as a controlling means outputs by processing the image formation data. The uniformly charged peripheral surface of the photosensitive drum 105 which is being rotated is scanned (exposed) by this beam of light L. As a result, an electrostatic latent image reflecting the image formation data obtained from the original is formed.

The electrostatic latent image is developed by a developing apparatus 108 into a visible image formed of toner (which hereinafter will be referred to as toner image). The toner image is electrostatically transferred from the peripheral surface of the photosensitive drum 105 onto a sheet of recording medium P (transfer medium) as an object to be heated, in the transferring portion T, that is, the location of a transfer charging apparatus 109, which is where the photosensitive drum 105 and transfer charging apparatus 109 oppose each other, and to which the recording medium P is conveyed, with a predetermined control timing, from the sheet feeding mechanism.

The sheet feeding mechanism of the image forming apparatus in this embodiment is provided with: a first sheet feeding cassette 110 in which recording mediums of a small size usable with the apparatus are stored; a second sheet feeding cassette 111 in which recording mediums of a large size usable with the apparatus are stored; and a recording medium conveying portion 112 which conveys, with the predetermined timing, to the transferring portion T, each of the recording mediums P fed, while being separated one by one, into the main assembly of the apparatus from the recording medium feeding cassette selected from the recording medium feeding cassette 110 and 111.

After a toner image is transferred from the peripheral surface of the photosensitive drum 105 onto the recording medium P in the transferring portion T, the recording medium P is separated from the peripheral surface of the photosensitive drum 105, and is conveyed to a fixing apparatus 114, in which the toner image (which has not been fixed) on the recording medium P is fixed to the recording medium P. After the fixation of the toner image, the recording medium P is discharged into a delivery tray 115 located outside the main assembly of the image forming apparatus.

Meanwhile, the peripheral surface of the photosensitive drum 105 is cleaned, that is, cleared of such adherent contaminants as the toner remaining on the peripheral surface of the photosensitive drum 105, by a cleaning apparatus 115, and then, is used for the next cycle of image formation; the peripheral surface of the photosensitive drum 105 is repeatedly used for image formation.

(2) Fixing Apparatus 114

Figure 2:
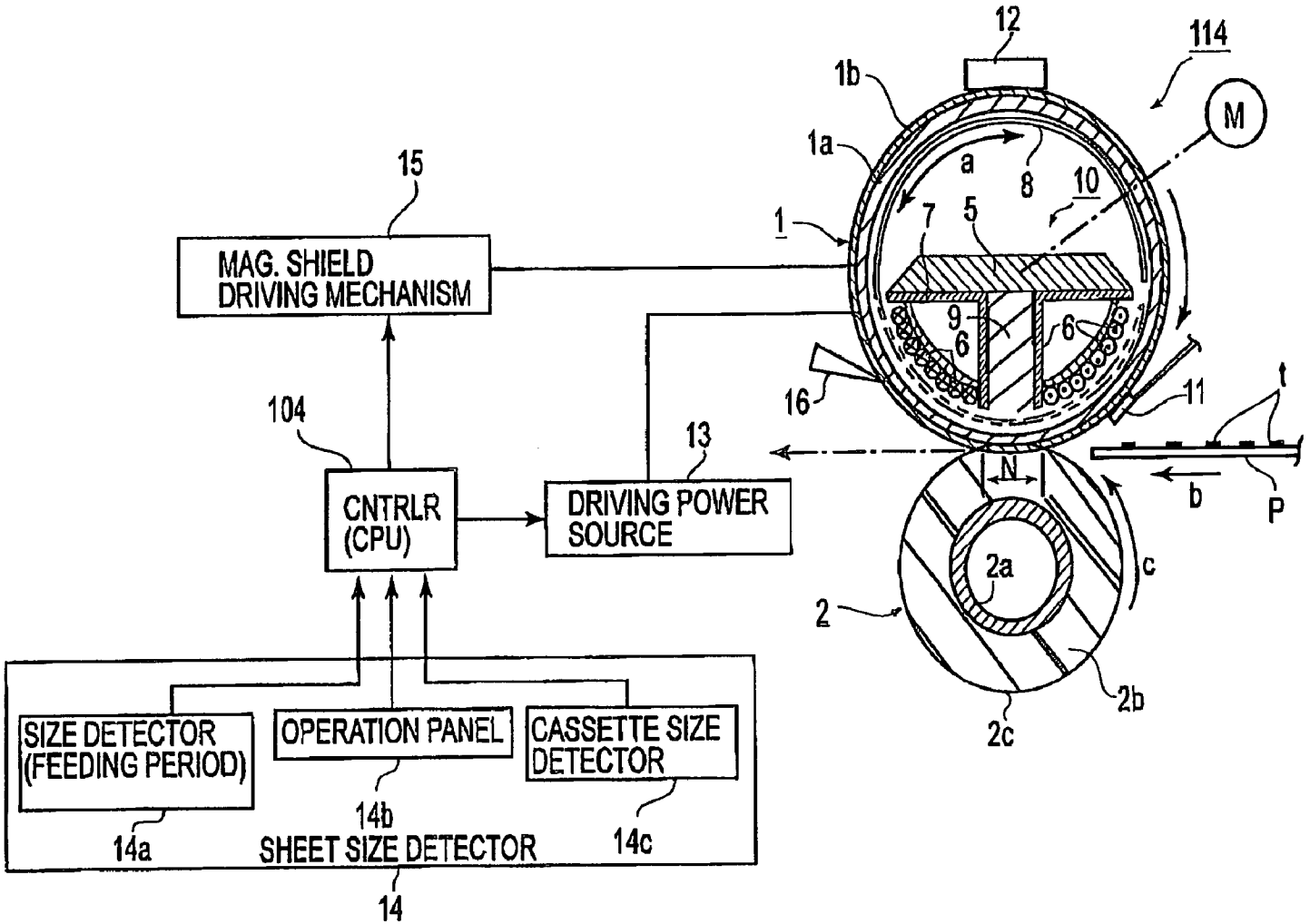
FIG. 2 is an enlarged sectional view of the essential portions of the first embodiment of a fixing apparatus in accordance with the present invention.
Figure 3:
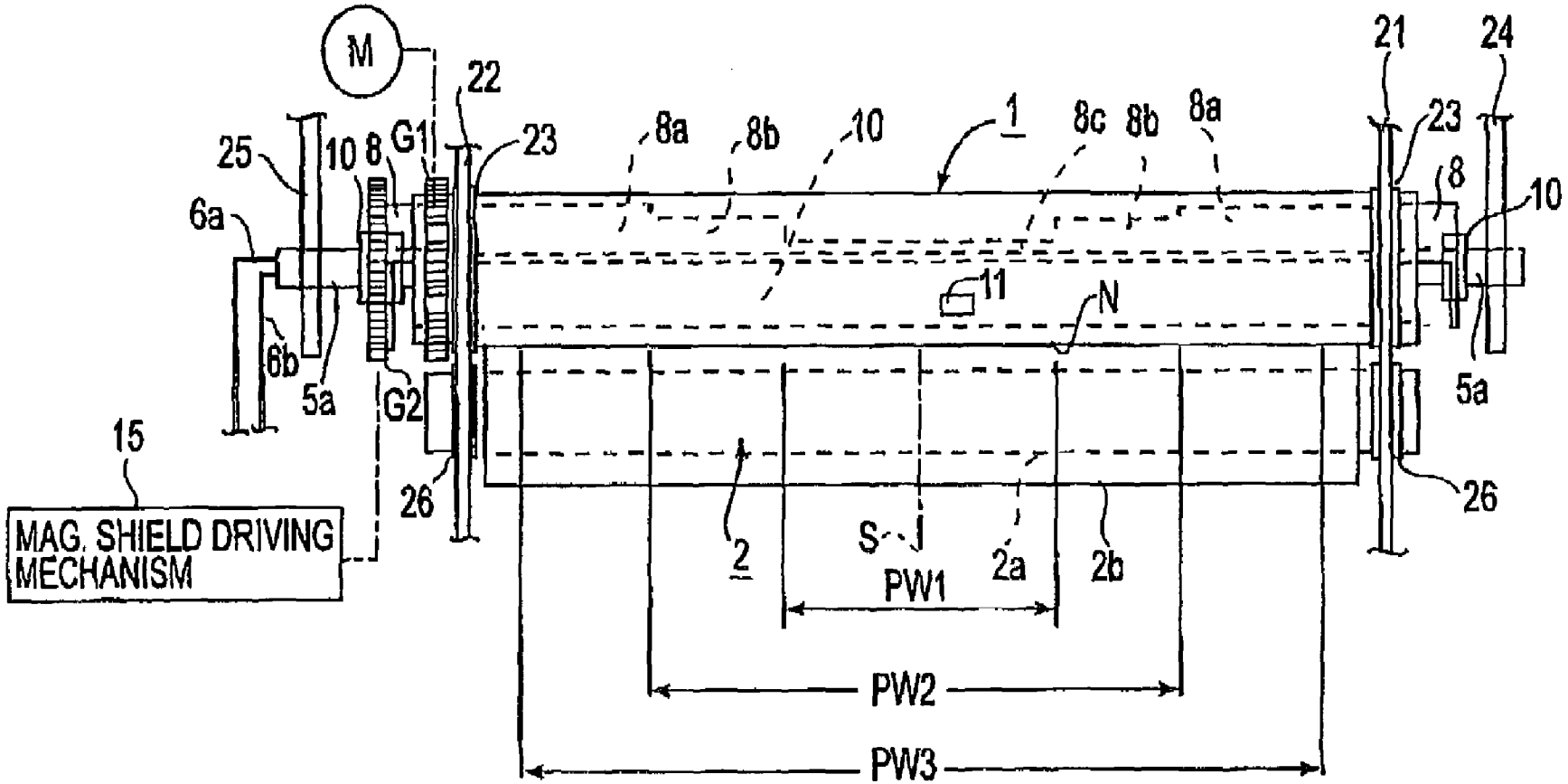
FIG. 3 is a front view of the essential portions of the first embodiment of a fixing apparatus in accordance with the present invention.

FIG. 2 is an enlarged cross-sectional view of the essential portions of the fixing apparatus 114 in this embodiment, and FIG. 3 is a schematic front view of the essential portion of the fixing apparatus.

The fixing apparatus 114 in this embodiment is a heating apparatus employing a heat roller and a heating method based on electromagnetic induction, It essentially has a rotatable member 1 (in which heat is generated by electromagnetic induction) as a heating member, and a pressure roller 2 as a pressure applying rotatable member. The rotatable member 1 and pressure roller 2 are kept pressed against each other with the application of a predetermined amount of pressure so that a pressure nip N with a predetermined dimension (nip width), in terms of the direction in which the recording medium P is conveyed, is formed.

The rotatable member 1 is made up of a metallic core 1*a* (which may be referred to as metallic layer, electrically conductive layer, etc.), and a heat resistant releasing layer 1*b* (which may be referred to as heat conductive member) coated on the peripheral surface of the metallic core 1*a*. The metallic core 1*a* is formed of such substance as Fe. Ni, or SUS 430, in which heat can be generated by electromagnetic induction. It is cylindrical and hollow, and the thickness of its wall is in the range of 0.02 mm-3.0 mm. The releasing layer 1*b* is formed of fluorinated resin or the like.

The rotatable member 1 (which hereinafter may be referred to as fixation roller) is rotatably supported, at the lengthwise ends, by the first lateral plates 21 and 22 (of fixation unit frame) of the fixing apparatus 114, with the positioning of bearings 23 and 23 between the lengthwise ends of the fixation roller 1 and first lateral plates 21 and 22, one for one. In the hollow of the fixation roller 1, a coil assembly 10 as magnetic flux generating means is disposed, which generates high frequency magnetic field for inducing electrical current (eddy current) in the fixation roller 1 to generate heat (Joule heat) in the fixation roller 1.

The pressure roller 2 is made up of a core shaft 2*a*, a heat resistant rubber layer 2*b* formed around the peripheral surface of the core shaft 2*a*, and a heat resistant releasing layer 2*c* formed of fluorinated resin or the like on the peripheral surface of the heat resistant rubber layer 2*b*. The pressure roller 2 is disposed under the fixation roller 1 in parallel to the fixation roller 1. It is rotatably supported between the aforementioned first lateral plates 21 and 22 by the first lateral plates 21 and 22, by the lengthwise ends of the core shaft 2*a*, with bearings 26 and 26 positioned between the lengthwise ends of the core shaft 2*a* and first lateral plates 21 and 22, one for one. Further, the pressure roller 2 is kept pressed on the bottom side of the fixation roller 1 with the application of a predetermined amount of pressure by an unshown pressing means so that a predetermined amount of contact pressure is kept by the resiliency of the heat resistant rubber layer 2*b* between the pressure roller 2 and fixation roller 1, and also, so that a nip N as a heating portion having a predetermined width is formed between the pressure roller 2 and fixation roller 1.

The coil assembly 10 is an assembly made up of a bobbin 7, a magnetic core 9 (core member) formed of magnetic substance, an exciting coil 6 (source of inductive heat generation), a stay 5 formed of a dielectric substance, etc. The magnetic core 9 is fitted in the through hole of the bobbin 7. The exciting coil 6 is formed of copper wire and is wound around the bobbin 7. The bobbin 7, magnetic core 9, and exciting coil 6 are rigidly supported by the stay 5. As for the material for the magnetic core 9, it is desired to be such a substance that is large in permeability and small is internal loss; for example, ferrite, Permalloy, Sendust, amorphous silicon steel, etc. The bobbin 7 functions as an insulating portion for insulating the magnetic core 9 and exciting coil 6 from each other.

The exciting coil 6 must be capable of generating an alternating magnetic flux strong enough for heating. Thus, it must be lower in electrical resistance and high in inductance. As the core wire of the exciting coil 6, Litz wire, that is, a predetermined number of strands of fine wires with a predetermined diameter, which are bound together, is used. As the fine wire, electrical wire covered with insulating substance is used. The Litz wire is wound multiple times around the magnetic core 9, following the contour of the bobbin 7, making up the exciting coil 6. Since Litz wire is wound around the magnetic core 9, which is rectangular, the resultant exciting coil 6 has a shape resembling that of a long boat, the lengthwise direction of which is parallel to that of the fixation roller 1. With the employment of this design, the magnetic core 9 is positioned near the center of the exciting coil 6. Designated by referential symbols 6*a* and 6*b* are two lead wires (power supplying lines) of the exciting coil 6. They are extended outward of the coil assembly 10 through the hollow of one of the cylindrical portions 5*a* of the stay 5, which extend from the lengthwise ends of the stay 5, one for one, and are connected to an exciting coil driving power source 13 for supplying the exciting coil 6 with high frequency electric current.

The coil assembly 10 is rigidly supported by the stay 5, which is formed integrally with, or separately from, the bobbin 7 and is rigidly and nonrotatively supported, by the lengthwise ends, one for one, by the second lateral plates 24 and 25, so that the stay 5 is held at a predetermined angle, and also, so that a predetermined amount of gap is provided between the internal surface of the fixation roller 1 and exciting coil 6. The coil assembly 10 is disposed in the hollow of the fixation roller 1 so that no part of the coil assembly 10 is exposed from the fixation roller 1.

As a driving gear G1 attached to one of the lengthwise ends of the fixation roller 1 is rotationally driven by a driving force source M such as a motor, the fixation roller 1 is rotated in the clockwise direction indicated by an arrow mark a. As for the pressure roller 2, it is rotated by the rotation of the fixation roller 1 in the counterclockwise direction indicated by an arrow mark c.

The high frequency electric power source 13 supplies the exciting coil 6 of the coil assembly 10 with high frequency electric current (alternating current) in response to the signals from the control portion 104. The coil assembly 10 uses the high frequency electric current supplied from the power source 13, to generate multiple high frequency magnetic fields (alternating magnetic fluxes) which are parallel to the lengthwise direction of the fixation roller 1, and these alternating magnetic fluxes are guided to the magnetic core 9, inducing thereby eddy current in the portion of the fixation roller 1, which corresponds in position to the aforementioned nip N. This eddy current interacts with the electrical resistance (specific resistivity) of the fixation roller 1, generating thereby heat (Joule heat) in the portion of the fixation roller 1, which corresponds in position to the nip N; in other words, heat is generated in the fixation roller 1 (fixation roller 1 is heated) by eleotromagnetic induction. Since the fixation roller 1 is rotationally driven, it becomes uniform in surface temperature.

The fixing apparatus 114 is provided with a temperature sensor 11, as a means for detecting the temperature of the fixation roller 1, which is disposed in contact, or virtually in contact, with the peripheral surface of the fixation roller 1 so that it opposes the exciting coil 6 with the presence of the wall of the fixation roller 1 between the temperature sensor 11 and exciting coil 6. The temperature sensor 11 is a thermistor, for example, which detects the temperature of the fixation roller 1, and outputs signals which reflect the detected temperature. These temperature signals are used by the control portion 104 to control the electric power source 13 to regulate the amount of power supply to the exciting coil 6 so that the temperature of the fixation roller 1 remains at an optimal level for fixation. Incidentally, the temperature sensor 11 may be disposed in contact, or virtually in contact, with the internal surface of the fixation roller 1 so that it directly opposes the exciting coil 6.

The fixing apparatus 114 is also provided with a thermostat 21 as a safety mechanism for preventing the fixation roller 1 from abnormally increasing in temperature. The thermostat 21 is disposed in contact, or virtually in contact, with the peripheral surface of the fixation roller 1, and opens its contact portion as the temperature of the fixation roller 1 reaches a predetermined level, in order to cut off the power supply to the exciting coil 6 to prevent the temperature of the fixation roller 1 from exceeding the predetermined level.

While the fixation roller 1 and pressure roller 2 are rotationally driven, the recording medium P bearing the unfixed toner image t which has just been transferred onto the recording medium P is introduced into the fixing apparatus 114 from the direction indicated by an arrow mark b in FIG. 1, and fed into the nip N, through which the recording medium P is conveyed while remaining pinched between the fixation roller 1 and pressure roller 2. As the recording medium P is conveyed through the nip N, the heat from the heated fixation roller 1 and the pressure from the pressure roller 2 are applied to the recording medium P and the unfixed toner image t thereon. As a result, the unfixed toner image t is fixed to the recording medium P; a permanent copy is effected, After being conveyed through the nip N, the recording medium P is separated from the fixation roller 1 by a separation claw 16, the tip of which is in contact with the peripheral surface of the fixation roller 1, and then, it is conveyed further leftward in the drawing.

The abovementioned stay 5, separation claw 16, and bobbin 7, are formed of heat resistant and electrically insulative engineering plastic.

Designated by a referential symbol 8 is a magnetic flux blocking plate as a magnetic flux adjusting means. The magnetic flux blocking plate 8 is disposed between the fixation roller 1 and coil assembly 10; it is inserted between the fixation roller 1 and coil assembly 10. Referring to FIG. 1, the magnetic flux blocking plate 8 in this embodiment extends from one of the lengthwise ends of the fixation roller 1 to the other. It is rendered arcuate so that its curvature matches the contour of the exciting coil 6, on the side which faces the internal surface of the fixation roller 1, as well as the curvature of the internal surface of the fixation roller 1; it extends through the predetermined gap between the internal surface of the fixation roller 1 and coil assembly 10, having a predetermined gap from both of them. Next, referring to FIG. 3, the stay 5 is provided with the pair of cylindrical portions 5*a*, which extend from the lengthwise ends of the stay 5, one for one, in parallel to the lengthwise direction of the stay 5, and the magnetic flux blocking plate 8 is rotatably supported by the pair of cylindrical portions 5*a* of the stay 5, by the lengthwise ends, with a pair of bearings 10 placed between the lengthwise ends of the magnetic flux blocking plate 8 and the cylindrical portions 5*a*, respectively. In other words, the magnetic flux blocking plate 8 is supported in such a manner that it can be rotated to be placed between the fixation roller 1 and the coil assembly 10, that is, the assembly made up of the bobbin 7, magnetic core 9, exciting coil 6, stay 5, etc., in the area which corresponds in position to the nip N. As for the material for the magnetic flux blocking member 8, nonmagnetic metallic substances such as copper, aluminum, silver, alloy containing any of the preceding nonmagnetic metals, etc., which are electrically conductive and small in specific resistivity, are suitable. As for the shape of the magnetic flux adjusting member 8, the magnetic flux blocking member 8 is shaped so that the magnetic flux which is emitted from the coil assembly 10 toward the fixation roller 1 can be adjusted in density in terms of the lengthwise direction of the nip, that is, the direction perpendicular to the recording medium conveyance direction, by the magnetic flux blocking member 8. The shape of the magnetic flux blocking member 8 will be described later in more detail.

As for the alignment of a recording medium relative to this embodiment of the present invention, or the fixing apparatus 114, a recording medium P is conveyed so that the center line of the recording medium P coincides with the center of the compression nip N in terms of the lengthwise direction of the fixing apparatus 114. Designated by a referential symbol PW3 is an area corresponding to the path of a recording medium of a large size (for example, sizes A4Y, A3, etc.), and designated by a referential symbol PW2 is an area corresponding to a recording medium of a medium size (for example, sizes B5Y, B4, etc.). Designated by a referential symbol PW1 is an area corresponding to a recording medium of a small size (for example, size A4R or smaller).

Designated by a referential symbol 14 is a recording medium size detecting means for detecting the size of the recording medium P. For example, the image forming apparatus 100 is designed so that the CPU 104 determines the recording medium size on the basis of the combination of the signals inputted as a user presses some of the multiple push switches of the control panel of the image forming apparatus. The recording medium size detecting means 14 may be structured as follows: It comprises: a recording medium size detecting means 14*a* for detecting the recording medium size while a recording medium is conveyed: a control panel 14*b*, and a cassette size detecting means 14*c*. Each of the cassette size detecting means 14*c* and recording medium size detecting means 14*a* Is an ultrasonic sensor, or the like. Basically, the control portion 104 determines the size of a recording medium based on the signal reflecting one of the predetermined recording medium sizes selected by a user through the control panel. However, for the purpose of preventing errors, in the recording medium size determination, attributable to the operational errors made by a user, and the placement of wrong recording mediums in either of the sheet feeder cassettes 110 and 111, the size of a recording medium being conveyed may be determined based on the combination of the signal outputted by the above mentioned sensors disposed in the sheet feeder cassettes 110 and 111, recording medium conveyance path 112, and the above described signal from the control panel.

Designated by a referential symbol 15 is magnetic flux blocking plate driving mechanism, which is a mechanism for controlling the position of the magnetic flux blocking plate 8 in response to the signals from the control portion 104. The driving mechanism 15 is a driving system comprising a motor, etc. As a gear G2 attached to one of the lengthwise ends of the magnetic flux blocking plate 8 is rotationally driven, the magnetic flux blocking plate 8 is rotationally driven in the circumferential direction of the fixation roller 1. As the motor therefor, a stepping motor or the like, for example, is employed. Incidentally, the structure of the magnetic flux blocking plate driving mechanism 15 does not need to be limited to the above described one. For example, the mechanism 15 may be structured so that the magnetic flux blocking plate 8 is indirectly controlled in position by a motor with the use of a belt or a screw, instead of being directly controlled by a motor.

Figure 4:
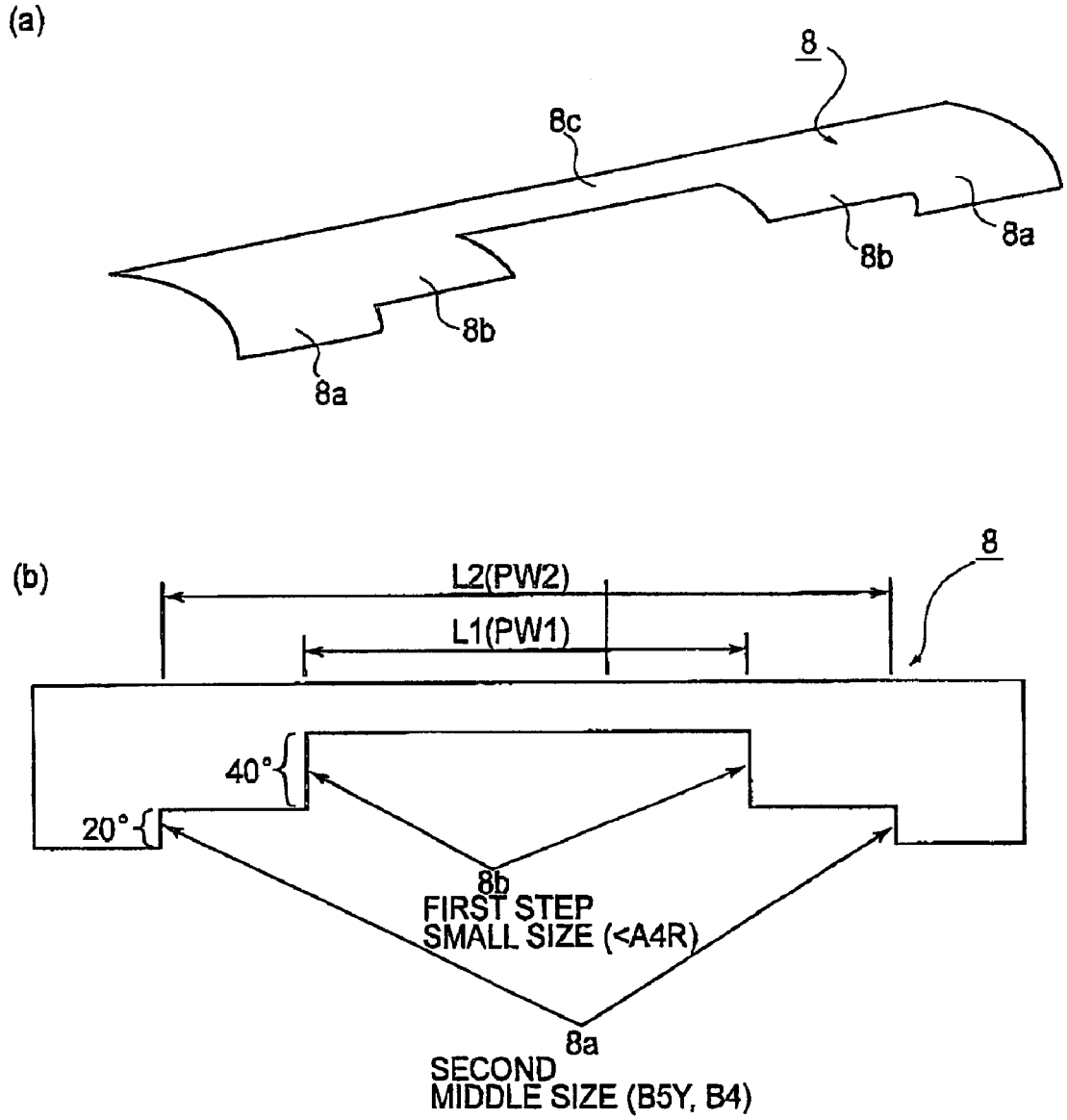
FIG. 4 is a drawing showing the structure of an example of the magnetic flux blocking plate of the first embodiment of a fixing apparatus in accordance with the present invention.

Next, FIG. 4 shows an example of the shape of the magnetic flux blocking plate 8; FIG. 4(*a*) and FIG. 4(*b*) are an external perspective view, and a developmental view, respectively, of the magnetic flux blocking plate 8.

The shape (contour) of the magnetic flux blocking plate 8 is as follows: One of its two edges parallel to the lengthwise direction of the fixation roller 1 is given multiple steps, enabling the magnetic flux blocking plate 8 to vary in steps the density distribution of the high frequency magnetic field generated by the coil assembly 10 (one of predetermined density distributions can be selected), according to the dimension (recording medium width) of the recording medium P in terms of the direction perpendicular to the recording medium conveyance direction. More specifically, the magnetic flux blocking plate 8 in this embodiment is provided with a pair of first magnetic flux blocking portions 8*a*, which are the portions extending outward from the first steps (counting from lengthwise end of plate 8), one for one, and a pair of second magnetic flux blocking portions 8*b*, which are the portions between the first and second steps, and a portion 8*b*, which is the portion between the second steps. In terms of the circumferential direction of the fixation roller 1, these magnetic flux blocking portions 8*a* and 8*b* extend predetermined distances from the theoretical extension of the edge of the portion 8*c* (edge between second steps). The portion 8*b* is the portion which connects the two (left and right) second magnetic flux blocking portions 8*b*. The first magnetic blocking portions 8*a* correspond to a recording medium of the medium size, for example, sizes B4, B5, etc., and the second magnetic flux blocking portions 8*b* correspond to a recording medium of a smaller size, that is, size A4R or smaller. In other words, the distance L2 between the inward edges of the two magnetic flux blocking portions 8*a* corresponds to the area PW2, In FIG. 3, which corresponds to the path of a recording medium of the medium size, and the distance L1 between the inward edges of the two magnetic flux blocking portions 8*b* correspond to the area PW1, in the same drawing, which corresponds to the path of a recording medium of a small size.

Figure 5:
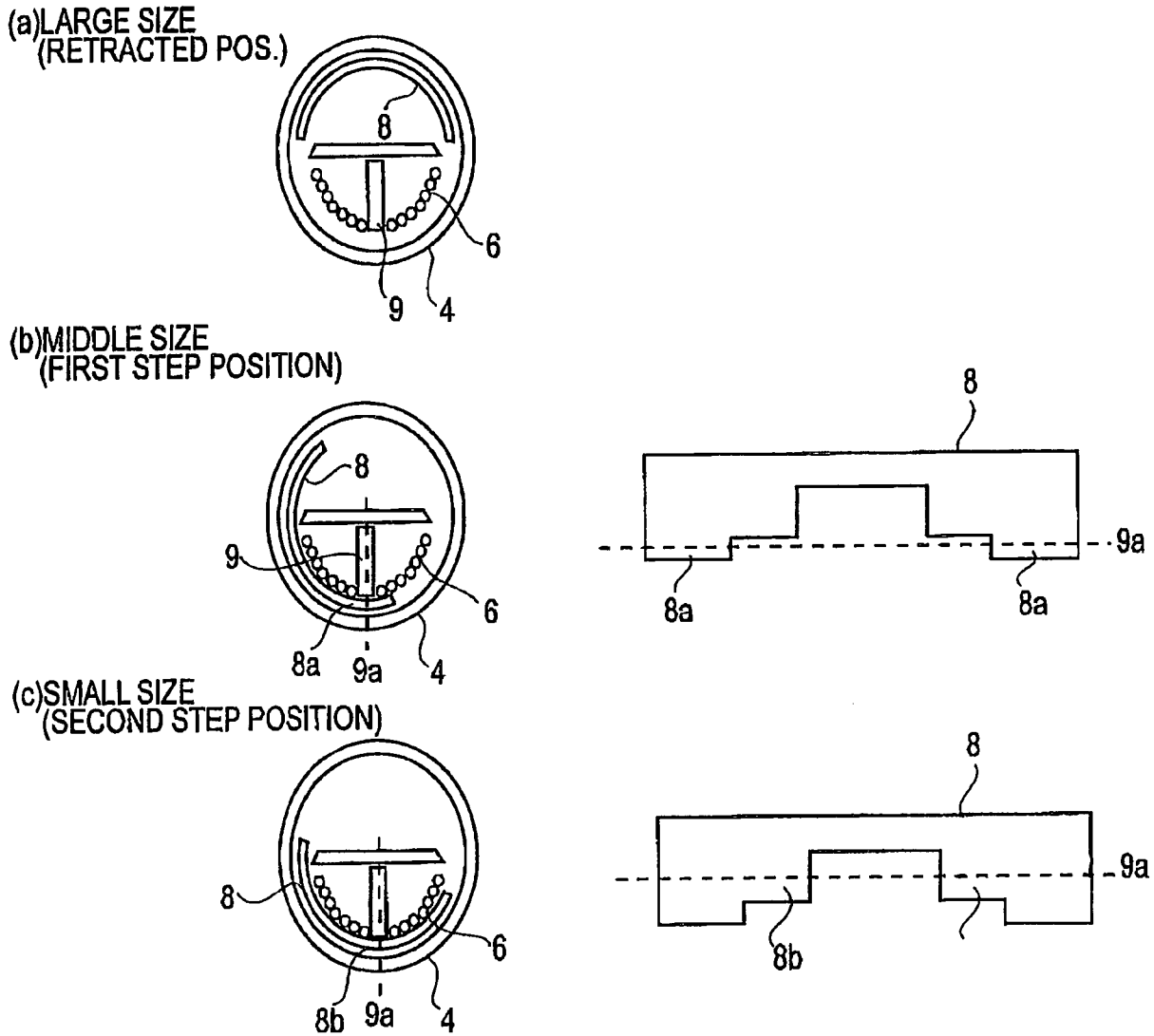
FIG. 5 is a drawing showing the various positions into which the magnetic flux blocking plate of the first embodiment of a fixing apparatus in accordance with the present invention is moved.

FIG. 5 shows the various positions into which the magnetic flux blocking plate 8 is moved. The movement of the magnetic flux blocking plate 8 is controlled by the control portion 104, which controls the movement of the magnetic flux blocking plate 8 by controlling the magnetic flux blocking plate driving mechanism 15 in response to the signals from the above described recording medium size detecting means 14.

The details of the movement of the magnetic flux blocking plate 8 in this embodiment is as follows: When recording mediums of one of the large sizes, for example, sizes A4Y, A3, etc., are used, the magnetic flux blocking plate 8 is rotated into a retreat, that is, a predetermined position, shown in FIG. 5(*a*), in which the magnetic flux blocking plate 8 does not overlap with the exciting coil 6 in terms of the radius direction of the fixation roller 1, that is, the position in which the magnetic flux blocking plate 8 interferes with virtually no part of the high frequency magnetic field (which hereinafter will be referred to as magnetic flux) which the exciting coil 6 generates. In other words, when the magnetic flux blocking plate 8 is in this position, the magnetic flux, which is generated by the exciting coil 6 and acts on the fixation roller 1, is not adjusted in density distribution by the magnetic flux blocking plate 8, that is, the magnetic flux is not blocked by the magnetic flux blocking plate 8.

On the other hand, when recording mediums of one of the medium sizes, for example, sizes B5Y, B4, etc., are used, the magnetic flux blocking plate 8 is rotated so that only the magnetic flux blocking portions 8*a* of the magnetic flux blocking plate 8 are inserted between the magnetic core 9 (center core) and fixation roller 1, with the provision of predetermined gaps between the magnetic flux blocking portions 8*a* and magnetic core 9, and between the magnetic flux blocking portions 8*a* and fixation roller 1, as shown in FIG. 5(*b*). When the magnetic flux blocking plate 8 is in this position, the magnetic flux which acts on the fixation roller 1 is adjusted in density distribution by the magnetic flux blocking portions 8*a*; in other words, the magnetic flux is partially blocked by the magnetic flux blocking portions 8*a*. Therefore, the lengthwise end portions of the fixation roller 1, which correspond in position to the magnetic flux blocking portions 8*a*, that is, the portions of the fixation roller 1, which correspond to the areas through which no recording medium is conveyed when recording mediums of a medium size are processed for image fixation, are prevented from increasing in temperature even while recording mediums of a medium size are consecutively conveyed through the fixing apparatus 114.

When recording mediums of a size A4R or smaller are used, the magnetic flux blocking plate 8 is rotated so that only the magnetic flux blocking portions 8*b* of the magnetic flux blocking plate 8 are inserted between the magnetic core 9 (center core) and fixation roller 1, with the provision of predetermined gaps between the magnetic flux blocking portions 8*b* and magnetic core 9, and between the magnetic flux blocking portions 8*b* and fixation roller 1, as shown in FIG. 5(*c*). When the magnetic flux blocking plate 8 is in this position, the magnetic flux which acts on the fixation roller 1 is adjusted in density distribution by the magnetic flux blocking portions 8*b*; in other words, the magnetic flux is partially blocked by the magnetic flux blocking portions 8*b*. Therefore, the lengthwise end portions of the fixation roller 1, which correspond in position to the magnetic flux blocking portions 8*b*, that is, the portions of the fixation roller 1, which correspond in position to the areas through which no recording medium is conveyed when recording mediums of size A4R or smaller are processed for image fixation, are prevented from increasing in temperature even while recording mediums of the small size are consecutively conveyed through the fixing apparatus 114.

Next, referring to FIG. 6, the eddy current induced in the magnetic flux blocking plate 8 when the magnetic flux blocking plate 8 is in the magnetic flux blocking position (FIG. 5), which is between the magnetic core 9 and fixation roller 1, will be described along with the phenomenon that the magnetic flux blocking plate 8 is heated by the heat generated by this eddy current in the magnetic flux blocking plate 8 itself.

Figure 6:
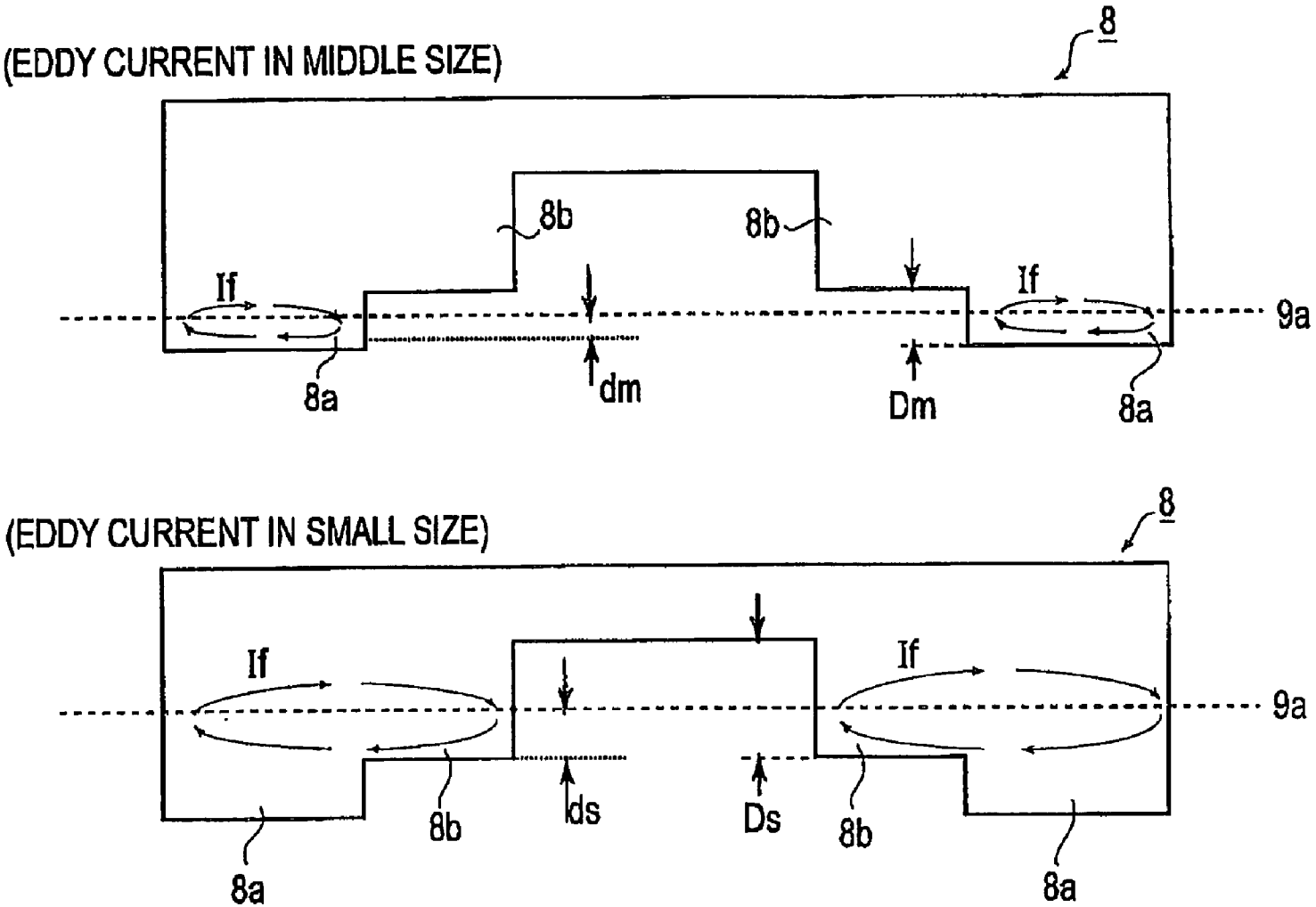
FIG. 6 is a drawing showing the eddy currents induced in the magnetic flux blocking plate of the first embodiment of a fixing apparatus in accordance with the present invention.

Referring to FIG. 6, when the magnetic flux blocking plate 8 is in the position into which it is rotated when recording mediums of a medium size or a small size are used, an eddy current If is induced in the magnetic flux blocking plate 8, in the portion corresponding in position to the center line 9*a* of the magnetic core 9, which is parallel to the lengthwise direction of the magnetic core 9. The heat generated in the magnetic flux blocking plate 8 is Joule heat, that is, the heat generated by the eddy current induced by the changes in the magnetic flux. The amount of the eddy current If is dependent upon the changes in the amount of the magnetic flux which penetrates the magnetic flux blocking plate 8. Therefore, the amount of the heat generated in the magnetic flux blocking plate 8 is greater when the recording mediums of a smaller size are conveyed, that is, when the areas (magnetic flux adjustment area) across which the magnetic flux is blocked by the magnetic flux blocking plate 8 are larger, than when the recording mediums of a medium size are conveyed.

Further, in terms of the circumferential direction of the fixation roller, when the distance Ds between the edge of the magnetic flux blocking portion 8*b*, which is parallel to the axial line of the fixation roller, and the dotted line, in FIG. 6(*a*), which corresponds in position to the center line 9*a* of the magnetic core 9 and is parallel to the axial line of the fixation roller 1, and the distance Dm between the edge of the magnetic flux blocking portion 8*a*, which is parallel to the axial line of the fixation roller, and the dotted line, in FIG. 6(*b*), which corresponds in position to the center line 9*a* of the magnetic core 9 and is parallel to the axial line of the fixation roller 1, are small, the eddy current If is concentrated in a small area, and therefore, the amount of the heat generated in the magnetic flux blocking plate 8 itself is greater.

The distance Ds between the dotted line, in FIG. 6(*a*), which corresponds in position to the center line 9*a* of the magnetic core 9, and the aforementioned edge of the magnetic flux blocking portions 8*b*, can be increased in absolute value by increasing the distance Ds between the edge of the portion 8*c*, and the aforementioned edge of the magnetic flux blocking portions 8*b* which is used when recording mediums of a small size are used. Therefore, the amount by which heat is generated in the magnetic flux blocking plate 8 itself can be reduced by increasing the distance Ds. As for the distance Dm, it is smaller than the distance Ds between the edge of the portion 8*c*, and the aforementioned edge of the magnetic flux blocking portions 8*b* which is used when recording mediums of a small size are used. In other words, the size of the step corresponding to the magnetic flux blocking portion 8*a* is smaller than the size of the step corresponding to the magnetic flux blocking portions 8*b*. Therefore, even if the distance Dm is reduced in absolute value, the amount by which heat is generated in the magnetic flux blocking plate 8 does not substantially increases.

On the other hand, if all of the steps between the adjacent two magnetic flux blocking portions (8*a* and 8*b*) of the magnetic flux blocking plate 8, which correspond to various sizes of a recording medium, are increased in size, the magnetic flux blocking plate 8 becomes too large in terms of the circumferential direction of the fixation roller 1. That is, in the case of a fixing apparatus such as the one in this first embodiment, which is structured so that the coil assembly 10 and magnetic flux blocking plate 8 are disposed within the hollow of the fixation roller 1, the magnetic flux blocking plate 8 cannot be fully retracted when recording mediums of a large size are conveyed through the nip N.

Therefore, only the distance DM, or the size of the first step, corresponding to the magnetic flux blocking portion 8*a* used when recording mediums of a medium size are used, that is, when the amount by which heat is generated in the magnetic flux blocking plate 8 is relatively small, is rendered small, making it possible to fully retract the magnetic flux blocking plate 8 in spite of the limited space available for the retraction of the magnetic flux blocking plate 8. It should be noted here that it is very important that the dimensions Dm and Ds of the aforementioned first and second steps, respectively, of the magnetic flux blocking plate 8 are greater than the width of the magnetic core 9 in terms of the recording medium conveyance direction.

Table 1 shows the relationship between the temperature levels of the magnetic flux blocking plate 8 and exciting coil 6, and the various magnetic flux blocking plates 8 different in the dimension of the steps between the magnetic flux blocking portions 8*a* and 8*b*, and the steps between the magnetic flux blocking portions 8*b* and connective portion 8*c*. The magnetic flux blocking plate 8 in this first embodiment is formed of copper, the purity of which is no less than 99.9%. The exciting coil 6 is formed of Litz wire capable of withstanding a temperature level of no more than 230° C. It is wound 10 times so that its lengthwise direction becomes parallel to the lengthwise direction of the fixation roller 1. The fixation roller 1 is made up of a cylindrical substrate 1*a*, and a heat resistant releasing layer 1*b* coated on the peripheral surface of the substrate 1*a*. The cylindrical substrate 1*a* is formed of iron. It is 0.5 mm in thickness, and 35 mm in external diameter. The heat resistant layer 1*b* is formed of a fluorinated resin, and is 20 μm in thickness. The fixation roller 1 is rotated at a peripheral velocity of 250 mm/sec. The surface temperature of the fixation roller 1 is maintained at 190° C. by the combination of the temperature sensor 11 and high frequency electrical power source 13. The width of the magnetic core 9 in terms of the recording medium conveyance direction is 5 mm. In this embodiment, as long as the dimensions Dm and Ds of the aforementioned first and second steps of the magnetic flux blocking plate 8 are no less than 20° in terms of the rotational angle of the magnetic flux blocking plate 8, the magnetic flux can be satisfactorily blocked.

Table 1 shows the levels to which the temperatures of the exciting coil 6 and magnetic flux blocking plate 8 increased when recording mediums (64 g/m$^2$ in basis weight) of sizes A4Y, B5Y, and B5R were consecutively conveyed through the fixing apparatus 114.

TABLE 1

| | | A4Y | | B5Y | | B5R | | |
|---|---|---|---|---|---|---|---|---|
| 1st stp (deg.) | 2nd stp (deg.) | coil temp. (° C.) | plate temp. (° C.) | coil temp. (° C.) | plate temp. (° C.) | coil temp. (° C.) | plate temp. (° C.) | RSLT |
| 10 | 10 | 200 | 190 | non-blockable | | non-blockable | | N |
| 10 | 20 | 200 | 190 | non-blockable | | 250 | 260 | N |
| 10 | 30 | 200 | 190 | non-blockable | | 230 | 240 | N |
| 20 | 10 | 200 | 190 | 225 | 235 | non-blockable | | N |
| 20 | 20 | 200 | 190 | 225 | 235 | 250 | 260 | N |
| 20 | 30 | 200 | 190 | 225 | 235 | 230 | 240 | G |
| 20 | 40 | 200 | 190 | 225 | 235 | 215 | 225 | G |
| 20 | 50 | 200 | 190 | 225 | 235 | 205 | 215 | G |
| 30 | 10 | 200 | 190 | 215 | 225 | non-blockable | | N |
| 30 | 20 | 200 | 190 | 215 | 225 | 250 | 260 | N |
| 30 | 30 | 200 | 190 | 215 | 225 | 230 | 240 | F |
| 30 | 40 | 200 | 190 | 215 | 225 | 215 | 225 | G |
| 30 | 50 | non-blockable | | 215 | 225 | 205 | 215 | N |
| 40 | 10 | 200 | 190 | 210 | 220 | non-blockable | | N |
| 40 | 20 | 200 | 190 | 210 | 220 | 250 | 260 | N |
| 40 | 30 | 200 | 190 | 210 | 220 | 230 | 240 | F |
| 40 | 40 | non-blockable | | 210 | 220 | 215 | 225 | N |
| 50 | 10 | 200 | 190 | 207 | 217 | non-blockable | | N |
| 50 | 20 | 200 | 190 | 207 | 217 | 250 | 260 | N |
| 50 | 30 | non-blockable | | 207 | 217 | 230 | 240 | N |

G: Good
F: Fair
N: No good

It is evident from the test results in Table 1 that the amount by which heat is generated in the magnetic flux blocking plate 8 itself can be reduced by rendering the distance Ds, that is, the dimension of the step (second step) between the magnetic flux blocking portion 8*b* used when recording mediums of a small size are used, and connective portion 8*c*, greater than the distance Dm, that is, the dimension of the step (first step) between the magnetic flux blocking portions 8*a* used when recording mediums of a medium size are used, and magnetic flux blocking portions 8*b*. Therefore, rendering the distance Ds greater than the distance Dm can prevent the temperature of the exciting coil 6 from exceeding the highest temperature level which the exciting coil 6 can withstand, making it thereby possible to consecutively convey multiple recording mediums regardless of their sizes.

As described above, according to the present invention, the density distribution of the magnetic flux, in terms of the lengthwise direction of the compression nip, can be varied, in steps, according to the width of a recording medium in terms of the direction perpendicular to the recording medium conveyance direction. Therefore, it is unnecessary to move the magnetic flux blocking plate 8 in the lengthwise direction of the compression nip, which is perpendicular to the recording medium conveyance direction, when thermally processing recording mediums of a large size. Also according to the present invention, the distance Ds, that is, the dimension of the step (second step) between the magnetic flux blocking portion 8*b* used when recording mediums of a small size are used, and connective portion 8*c*, is rendered largest. Therefore, even when recording mediums of a small size are consecutively heated, the amount by which heat is generated in the magnetic flux blocking plate 8 itself remains virtually negligible. Therefore, the prevention of the wasteful generation of heat in the fixation roller 1 and prevention of the temperature increase in the area outside the path of a recording medium can be accomplished without increasing an image forming apparatus in size.

Further, in the case of this embodiment of the present invention, the magnetic flux adjusting member is made up of multiple magnetic flux blocking portions different in size, and the magnetic flux adjusting member is prevented from increasing in temperature, by rendering largest the distance Ds, that is, the dimension of the step between the magnetic flux blocking portion used when smallest recording mediums, in terms of the dimension perpendicular to the recording medium conveyance direction, are used, that is, when the portions of the magnetic flux adjusting member used for blocking the magnetic flux is largest in terms of the lengthwise direction of the fixation roller, and the connective portion of the magnetic flux blocking plate. However, the configuration of the magnetic flux adjusting member does not need to be limited to the one in this embodiment. For example, the increase in temperature of the magnetic flux adjusting member may be prevented by structuring the magnetic flux adjusting member so that the areas through which no recording medium is conveyed can be adjusted, in relative terms, in temperature distribution, by adjusting the magnetic flux in the area corresponding to the path of a recording medium. In such a case, the temperature increase of the magnetic flux adjusting member can be prevented by rendering largest the step between the magnetic flux adjusting portion of the magnetic flux adjusting member, which is largest in terms of the lengthwise direction of the fixation roller, and the magnetic flux adjusting portions next thereto.

Incidentally, the above described structure of the first embodiment of a heating apparatus in accordance with the present invention was not intended to limit the scope of the present invention. In other words, the structure may be variously modified according to the type of a heating apparatus to which the present invention is to be applied. For example, the fixation roller 1 does not need to be provided with the releasing layer 1*b*. In such a case, a recording medium P is conveyed by being placed directly in contact with the metallic core 1*a* of the fixation roller 1. Further, in the first embodiment, the component in which heat is generated by electromagnetic induction is the fixation roller 1. However, the present invention is also applicable to a heating apparatus employing an endless metallic belt formed of nickel or the like, as the component in which heat is generated by electromagnetic induction. Further, the magnetic flux blocking plate 8 in the first embodiment is provided with two sets of magnetic flux blocking portions different in size (edge of functional side of magnetic flux blocking plate has two sets of steps). However, the magnetic flux blocking plate 8 may be provided with three or more sets of magnetic flux blocking portions different in size (edge of functional side of magnetic flux blocking plate may be provided with three or more sets of steps). Moreover, the fixing apparatus may be provided with a cooling means for removing the heat generated in the magnetic flux blocking plate 8 itself by electromagnetic induction, and reducing the temperature of the exciting coil 6. As an example of the cooling means, a direct or indirect means employing a fan or the like may be employed.

Embodiment 2

Figure 7:
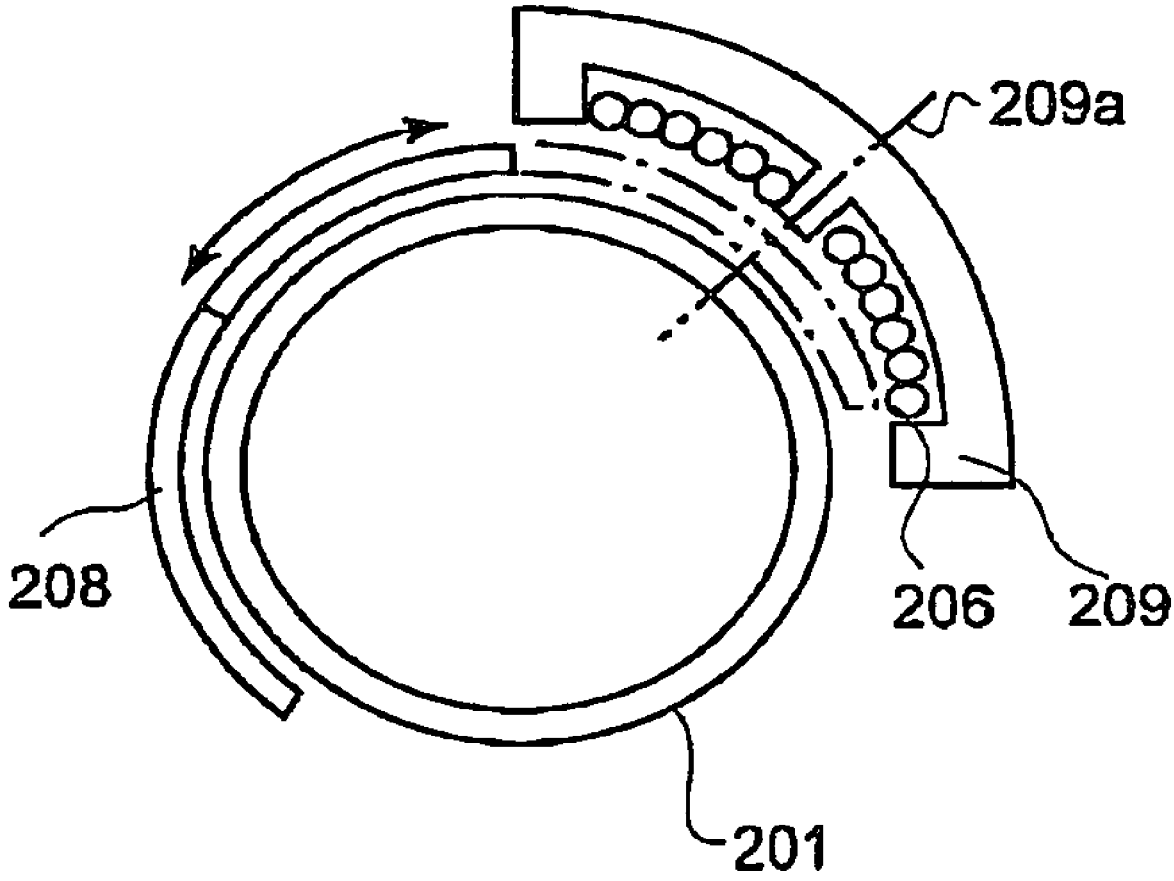
FIG. 7 is a schematic drawing showing the structures of the essential portions of the second embodiment of a fixing apparatus in accordance with the present invention.

FIG. 7 is a schematic drawing of another example of a heating apparatus, as the fixing apparatus 114, in accordance with the present invention, showing the general structure thereof. In this fixing apparatus 114, the exciting coil 206 and magnetic core 209 are disposed in the adjacencies of the peripheral surface of the fixation roller 201.

In the second embodiment, the fixing apparatus 114 is structured so that the magnetic flux blocking plate 208 can be rotated, following the peripheral surface of the fixation roller 201, into the gap between the fixation roller 201 and exciting coil 206 while maintaining predetermined gaps between the magnetic flux blocking plate 208 and fixation roller 201, and between the magnetic flux blocking plate 208 and exciting coil 206, respectively. Designated by a referential symbol 209*a* is the center line of the magnetic core 209, which divides the magnetic core 209 into the front and rear halves, in terms of the rotational direction of the fixation roller.

In the second embodiment, the magnetic flux blocking plate 208 and exciting coil 206 are disposed in the adjacencies of the peripheral surface of the fixation roller 201. Therefore, it is reasonable to think that heat will dissipate outward from the fixation roller 201, magnetic flux blocking plate 208, and exciting fixation roller 201 into the ambiences thereof, and therefore, the temperature increase of the magnetic flux blocking plate 208 attributable to the heat generation in the magnetic flux blocking plate 8 itself, and the temperature increase of the exciting coil 206, will be smaller than those in the above described first embodiment.

Figure 8:
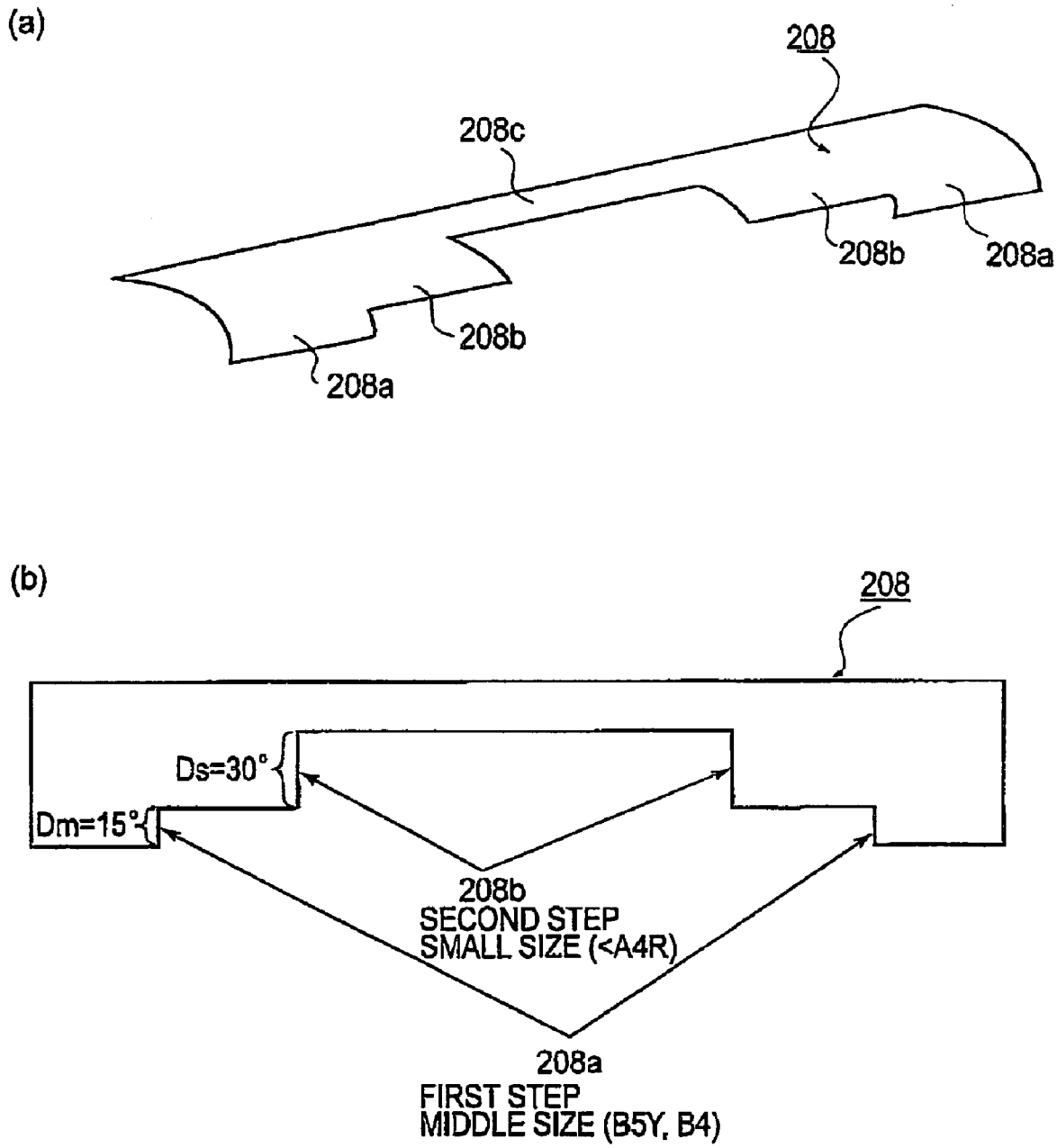
FIG. 8 is a drawing showing the structure of an example of the magnetic flux blocking plate of the second embodiment of a fixing apparatus in accordance with the present invention.

FIG. 8 shows the shape of the magnetic flux blocking plate 208 in the second embodiment; FIG. 8(*a*) is an external perspective view of the magnetic flux blocking plate 8, and FIG. 8(*b*) is a developmental view of the magnetic flux blocking plate 208. The contour of the magnetic flux blocking plate 208 is roughly the same as that of the magnetic flux blocking plate 8 in the first embodiment. In the second embodiment, the dimension Dm of the step (first step) between the magnetic flux blocking portion 208*a* of the magnetic flux blocking plate 208, which corresponds to a recording medium of a medium size, and the magnetic flux blocking portion 208*b* of the magnetic flux blocking plate 208, which corresponds to a recording medium of a small size, is set to 15°, and the dimension Ds of the step (second step) between the magnetic flux blocking portion 8*b*, which corresponds to a recording medium of a small size, and the connective portion 208*c* of the magnetic flux blocking plate 208, which connects the magnetic flux blocking potions 208*a* and 208*b*, is set to 30°.

Figure 9:
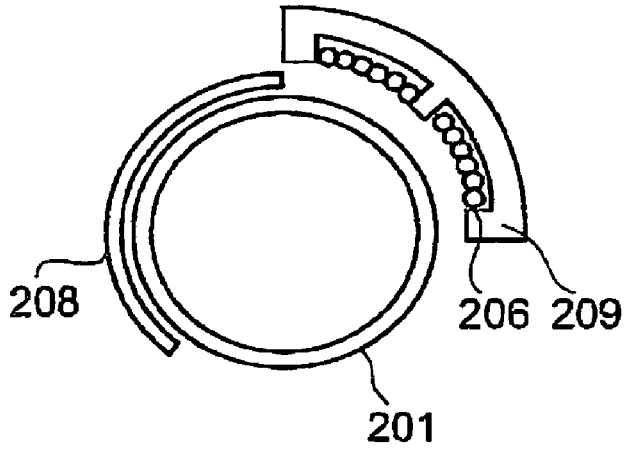
FIG. 9 is a drawing showing the various positions into which the magnetic flux blocking plate of the second embodiment of a fixing apparatus in accordance with the present invention is moved.
Figure 9:
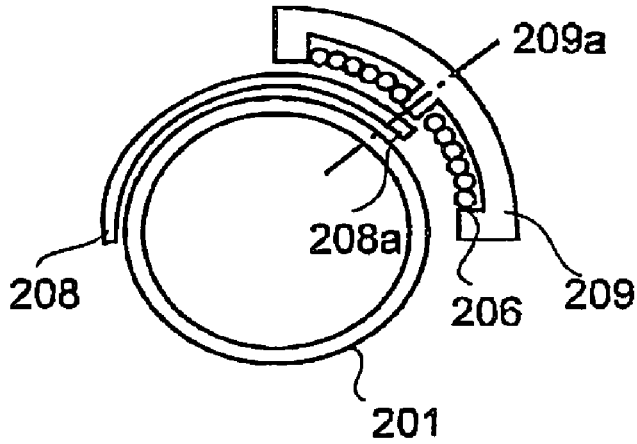
Figure 9:
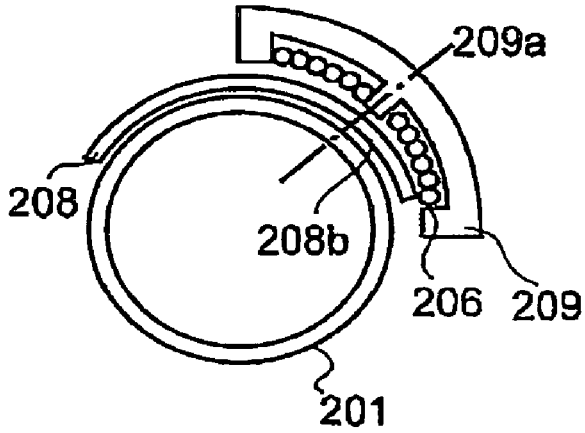

FIG. 9 is shows the various positions into which the magnetic flux blocking plate 208 are moved for partially blocking, or not blocking, the magnetic flux. The movement of the magnetic flux blocking plate 208 is controlled by a control portion 104, which controls the magnetic flux blocking plate 208 by controlling a magnetic flux blocking plate driving mechanism 15 in response to the signals from a recording medium size detecting means 14 such as the one described above.

The details of the movement of the magnetic flux blocking plate 208 in the second embodiment is as follows: When recording mediums of one of the large sizes, for example, sizes A4Y, A3, etc., are used, the magnetic flux blocking plate 208 is rotated into a retreat, that is, a predetermined position, shown in FIG. 9(*a*), in which the magnetic flux blocking plate 208 does not overlap with the exciting coil 6 in terms of the radius direction of the fixation roller 1, that is, the position in which the magnetic flux blocking plate 208 interferes with virtually no part of the magnetic flux which the exciting coil 206 generates. In other words, when the magnetic flux blocking plate 208 is in this position, the magnetic flux, which is generated by the exciting coil 6 and acts on the fixation roller 1, is not adjusted in density distribution by the magnetic flux blocking plate 208, that is, the magnetic flux is not blocked by the magnetic flux blocking plate 208.

On the other hand, when recording mediums of one of the medium sizes, for example, sizes B5Y, B4, etc., are used, the magnetic flux blocking plate 208 is rotated so that only the magnetic flux blocking portions 208*a* of the magnetic flux blocking plate 208 are inserted between the magnetic core 209 and fixation roller 1, with the provision of predetermined gaps between the magnetic flux blocking portions 208*a* and magnetic core 209, and between the magnetic flux blocking portions 208*a* and fixation roller 201, as shown in FIG. 9(*b*). When the magnetic flux blocking plate 208 is in this position, the magnetic flux generating from the exciting coil 206 is adjusted in density distribution by the magnetic flux blocking portions 208*a*; in other words, the magnetic flux is partially blocked by the magnetic flux blocking portions 208*a*. Therefore, the lengthwise end portions of the fixation roller 201, which correspond in position to the magnetic flux blocking portions 208*a* which partially cover the fixation roller 201 when recording mediums of a medium size are processed for image fixation, are prevented from increasing in temperature even while recording mediums of a medium size are consecutively conveyed through the fixing apparatus 114.

When recording mediums of a size A4R or smaller are used, the magnetic flux blocking plate 208 is rotated so that only the magnetic flux blocking portions 208*b* of the magnetic flux blocking plate 208 are inserted between the magnetic core 209 and fixation roller 201, with the provision of predetermined gaps between the magnetic flux blocking portions 208*b* and magnetic core 209, and between the magnetic flux blocking portions 208*b* and fixation roller 201, as shown in FIG. 9(*c*). When the magnetic flux blocking plate 208 is in this position, the magnetic flux generating from the exciting coil 206 is adjusted in density distribution by the magnetic flux blocking portions 208*b*; in other words, the magnetic flux is partially blocked by the magnetic flux blocking portions 208*b*. Therefore, the lengthwise end portions of the fixation roller 201, which correspond in position to the magnetic flux blocking portions 208*b*, one for one, which partially cover the fixation roller 201 when recording mediums of a small size are processed for image fixation, are prevented from increasing in temperature even while recording mediums of the small size are consecutively conveyed through the fixing apparatus 114.

Also in the second embodiment, the dimension Ds of the step (second step) of the magnetic flux blocking plate 208, which corresponds to a recording medium of a small size, is rendered greater than the dimension Dm of the step (first step) of the magnetic flux blocking plate 208, which corresponds to a recording medium of a medium size. In other words, the fixing apparatus in this embodiment is similar in function and effect to that in the first embodiment. Therefore, it can heat recording mediums without increasing the temperature of the exciting coil 206 beyond the highest temperature level which the exciting coil 206 can withstand.

Incidentally, the above described structure of the second embodiment of a heating apparatus in accordance with the present invention is not intended to limit the scope of the present invention. Obviously, the structure may be variously modified as described above.

Embodiment 3

Figure 10:
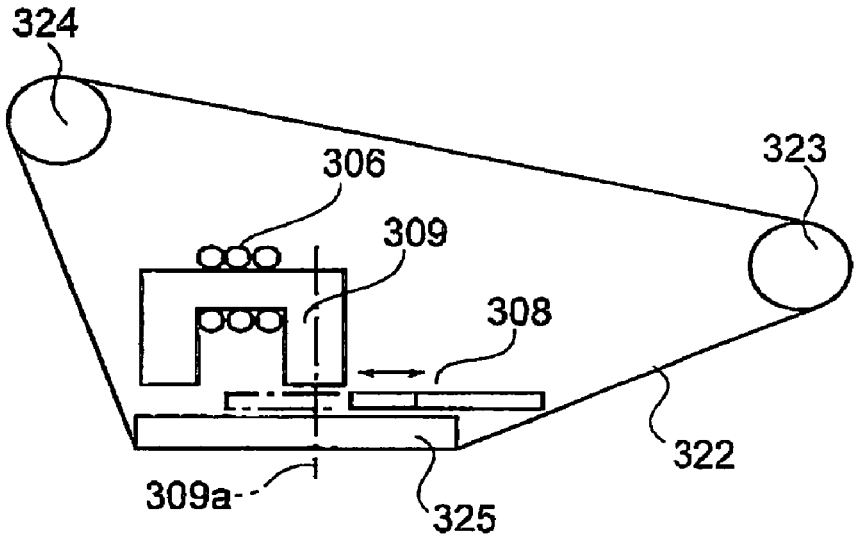
FIG. 10 is a schematic drawing showing the structures of the essential portions of the third embodiment of a fixing apparatus in accordance with the present invention.

FIG. 10 is a schematic drawing of another example of a heating apparatus 114, as a fixing apparatus, in accordance with the present invention, showing the general structure thereof. In this fixing apparatus 114, the rotatable member is disposed in a manner to surround the member in which heat is generated by electromagnetic induction.

In the first and second embodiments, the rotatable member (fixation roller) itself is the heating member, and heat is generated in the heating member itself. The third embodiment is characterized in that its rotatable member is independent from its heating member, or the member in which heat is generated. The exciting coil 306 as a magnetic flux generating means is wound around the magnetic core 309, and induces eddy current in the heating plate 325, as a heating member, in order to generate heat in the heating plate 325. The endless belt 322, as a rotatable member to be heated by being placed in contact with the heating plate 325, is stretched around the pair of rollers 323 and 234, being thereby suspended by the rollers. It is circularly moved by an unshown driving means. As the endless belt 322, an endless belt formed of such a resin as polyimide may be employed. The fixing apparatus 114 is structured so that the magnetic flux blocking plate 308 can be moved, along the outwardly facing surface of the heating plate 325, through the gap between the magnetic core 309 and heating plate 325, in order to allow the magnetic flux blocking plate 308 to be inserted between the magnetic core 309 and heating plate 325 while maintaining predetermined distances between the magnetic flux blocking plate 308 and magnetic core 309, and between the magnetic flux blocking plate 308 and heating plate 325, respectively. Designated by a referential symbol 309*a* is the center line of the magnetic core 309, which divides the magnetic core 309 into the front and rear halves, in terms of the rotational direction of the endless belt 322.

Figure 11:
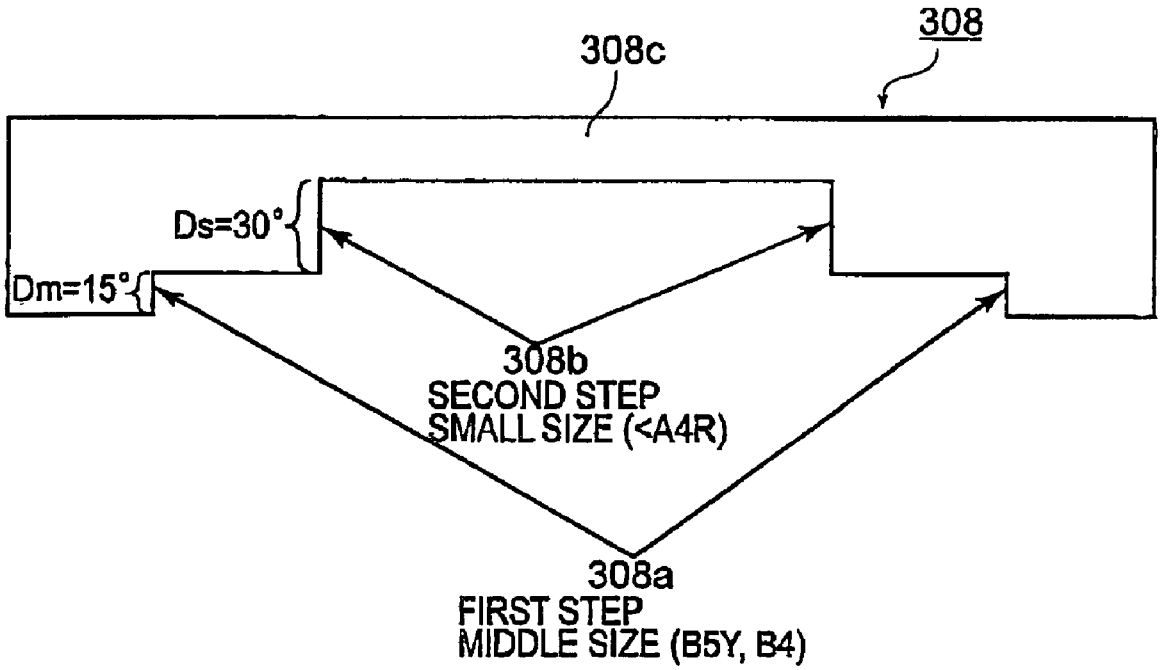
FIG. 11 is a drawing showing the structure of an example of the magnetic flux blocking plate of the third embodiment of a fixing apparatus in accordance with the present invention.

FIG. 11 is a plan view of the magnetic flux blocking plate 308 in the third embodiment. The contour of the magnetic flux blocking plate 308 is roughly the same as that of the magnetic flux blocking plate 8 in the first embodiment. In the third embodiment, the dimension DM of the step (first step) between the magnetic flux blocking portion 308*a* of the magnetic flux blocking plate 308, which corresponds to a recording medium of a medium size, and the magnetic flux blocking portion 308*b* of the magnetic flux blocking plate 308, which corresponds to a recording medium of a small size, is set to 15°, and the dimension Ds of the step (second step) between the is magnetic flux blocking portion 8*b*, which corresponds to a small size, and the connective portion 308*c* which connects the magnetic flux blocking potions 308*a* and 308*b*, is set to 30°.

Figure 12:
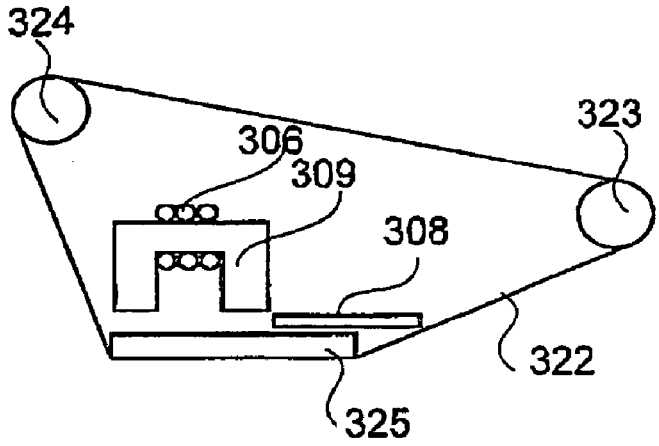
FIG. 12 is a drawing showing the various positions into which the magnetic flux blocking plate of the third embodiment of a fixing apparatus in accordance with the present invention is moved.
Figure 12:
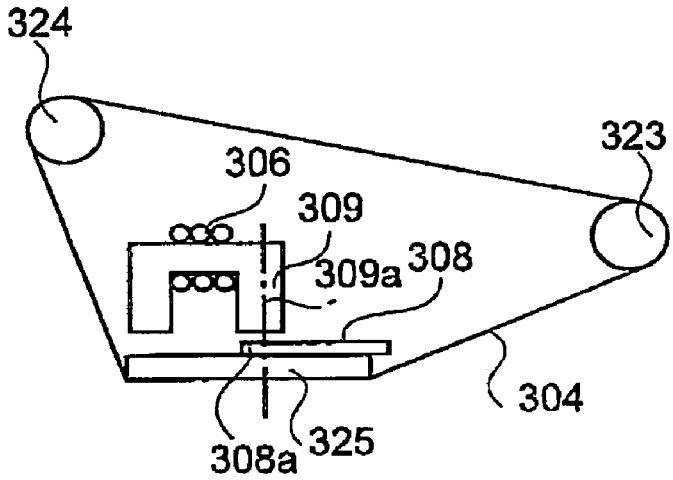
Figure 12:
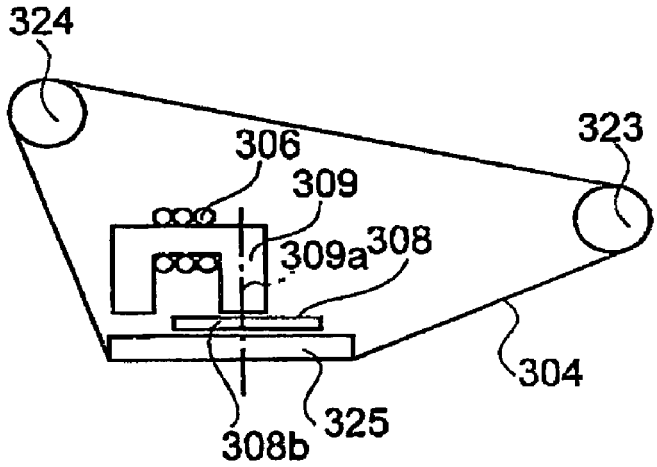
Figure 13:
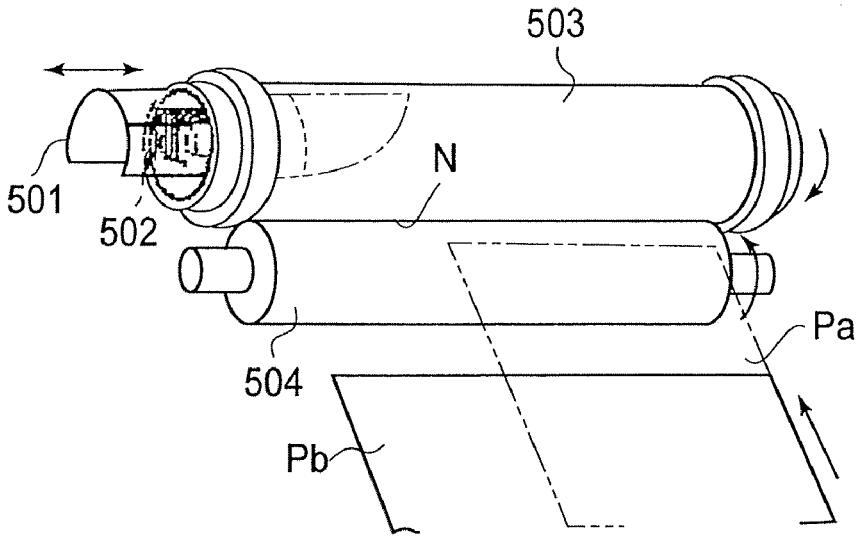
FIG.13 PRIOR ART
FIG. 13 is a schematic drawing of a heating apparatus in accordance with prior arts.
Figure 14:
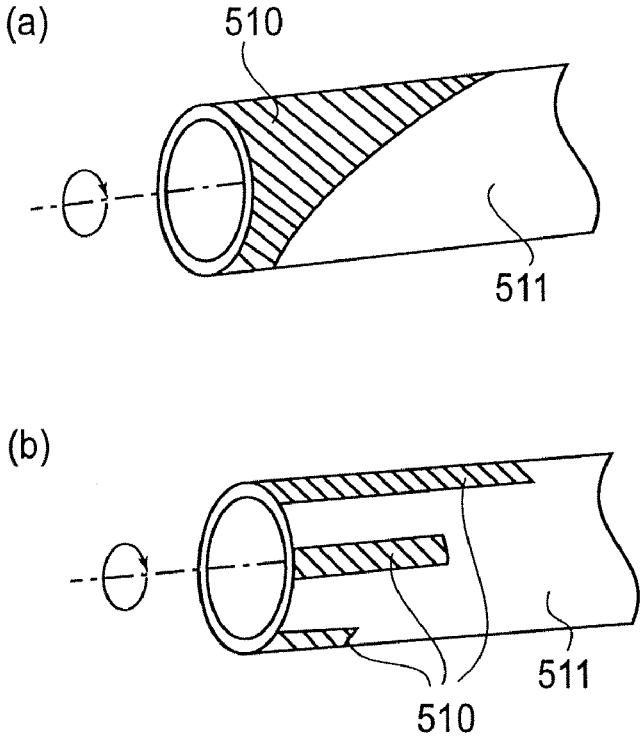
FIG.14 PRIOR ART
FIG. 14 is a schematic drawing showing the structure of the magnetic flux blocking means in accordance with prior arts.

FIG. 12 is shows the various positions into which the magnetic flux blocking plate 308 are moved for partially blocking, or not blocking, the magnetic flux. The movement of the magnetic flux blocking plate 308 is controlled by a control portion 104, which controls the magnetic flux blocking plate 308 by controlling a magnetic flux blocking plate driving mechanism 15 in response to the signals from a recording medium size detecting means 14 such as the one described above.

The details of the movement of the magnetic flux blocking plate 308 in the third embodiment is as follows: When recording mediums of one of the large sizes, for example, sizes A4Y, A3, etc., are used, the magnetic flux blocking plate 308 is moved into a retreat, that is, a predetermined position, shown in FIG. 12(*a*), in which the magnetic flux blocking plate 308 does not overlap with the exciting coil 306 in terms of the direction perpendicular to the heating plate 325, that is, the position in which the magnetic flux blocking plate 308 interferes with virtually no part of the magnetic flux which the exciting coil 306 generates. In other words, when the magnetic flux blocking plate 308 is in this position, the magnetic flux, which is generated by the exciting coil 306 and acts on the fixation roller 1, is not adjusted in density distribution by the magnetic flux blocking plate 308, that is, the magnetic flux is not blocked by the magnetic flux blocking plate 308.

On the other hand, when recording mediums of one of the medium sizes, for example, sizes B5Y, B4, etc., are used, the magnetic flux blocking plate 308 is moved so that only the magnetic flux blocking portions 308*a* of the magnetic flux blocking plate 308 are inserted between the magnetic core 309 and heating plate 325, with the provision of predetermined gaps between the magnetic flux blocking portions 308*a* and magnetic core 309, and between the magnetic flux blocking portions 308*a* and heating plate 325, as shown in FIG. 12(*b*). When the magnetic flux blocking plate 308 is in this position, the magnetic flux, which is generated by the exciting coil 306 and acts on the heating plate 325, is adjusted in density distribution by the magnetic flux blocking portions 308*a*; in other words, the magnetic flux is partially blocked by the magnetic flux blocking portions 308*a*. Therefore, the lengthwise end portions of the heating plate 325, which correspond in position to the magnetic flux blocking portions 308*a* which partially cover the heating plate 325 when recording mediums of a medium size are processed for image fixation, are prevented from increasing in temperature even while recording mediums of a medium size are consecutively conveyed through the fixing apparatus 114.

When recording mediums of a size A4R or smaller are used, the magnetic flux blocking plate 308 is moved so that only the magnetic flux blocking portions 308*b* of the magnetic flux blocking plate 308 are inserted between the magnetic core 309 and heating plate 325, with the provision of predetermined gaps between the magnetic flux blocking portions 308*b* and magnetic core 309, and between the magnetic flux blocking portions 308*b* and heating plate 325, as shown in FIG. 12(*c*). When the magnetic flux blocking plate 308 is in this position, the magnetic flux, which is generated by the exciting coil 306 and acts on heating plate 325, is adjusted in density distribution by the magnetic flux blocking portions 308*b*: in other words, the magnetic flux is partially blocked by the magnetic flux blocking portions 308*b*. Therefore, the lengthwise end portions of the heating plate 325, which correspond in position to the magnetic flux blocking portions 308*b*, one for one, which partially cover the heating plate 325 when recording mediums of a small size are processed for image fixation, are prevented from increasing in temperature even while recording mediums of the small size are consecutively conveyed through the fixing apparatus 114.

Also in the third embodiment, the dimension Ds of the step (second step) of the magnetic flux blocking plate 308, which corresponds to a recording medium of a small size, is rendered greater than the dimension Dm of the step (first step) of the magnetic flux blocking plate 308, which corresponds to a recording medium of a medium size. In other words, the fixing apparatus in this embodiment is similar in function and effect to that in the first embodiment. Therefore, it can heat recording mediums without increasing the temperature of the exciting coil 306 beyond the highest temperature level which the exciting coil 306 can withstand.

Incidentally, in the third embodiment, the magnetic flux blocking plate 308 is virtually flat. However, the magnetic flux blocking plate 308 may be rendered arcuate so that it better conforms to the shape of the fixing apparatus. The above described structure of the third embodiment of a heating apparatus in accordance with the present invention is not intended to limit the scope of the present invention. Obviously, the structure may be variously modified as described above.

[Miscellaneous]

The usage of the heating apparatus, in accordance with the present invention, which employs the heating method based on electromagnetic induction, is not limited to the usage as the thermal fixing apparatus for an image forming apparatus like the preceding embodiments. For example, it is effective as such an image heating apparatus as a fixing apparatus for temporarily fixing an unfixed image to a sheet of recording paper, a surface property changing apparatus for reheating a sheet of recording paper bearing a fixed image to change the sheet of recording medium in surface properties, such as glossiness. Obviously, it is also effectively usable as a thermal pressing apparatus for removing wrinkles from a paper money or the like, a thermal laminating apparatus, a thermal drying apparatus for causing the water content in paper or the like to evaporate, a heating apparatus for thermally processing an object in the form of a sheet, and the like apparatuses.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 308502/2004 filed Oct. 22, 2004 which is hereby incorporated by reference.

What is claimed is:

1. A image heating apparatus comprising:

a coil for generating magnetic flux;

a rotatable heat generation member having a heat generation portion, which generates heat by magnetic flux, for heating an image on a recording material; and movable magnetic flux blocking means for blocking the magnetic flux directed toward said heat generation member from said coil, said magnetic flux blocking means including first and second magnetic flux blocking portions, arranged in a moving direction of said movable magnetic flux blocking means, for blocking, at an end portion of said heat generation member with respect to a rotation axial direction, the magnetic flux directing from said coil toward said heat generation member, wherein a magnetic flux blocking length of said second magnetic flux blocking portion measured in the rotation axial direction is longer than a magnetic flux blocking length of said first magnetic flux blocking portion measured in the rotation axial direction, and a magnetic flux blocking length of said second magnetic flux blocking portion measured in the moving direction is longer than a magnetic flux blocking length of said first magnetic flux blocking portion measured in the moving direction;

moving means for moving said magnetic flux blocking means.

2. A apparatus according to claim 1, wherein said magnetic flux blocking means moves said first magnetic flux blocking portion to a first position to provide a first magnetic flux distribution and moves said second magnetic flux blocking portion to a second position to provide a second magnetic flux distribution, on the basis of a width of the recording material measured in the rotational axis direction of said rotatable heat generating member.

3. A apparatus according to claim 1, wherein said second magnetic flux blocking portion adjusts a magnetic flux distribution when the recording material having a minimum width measured in the rotational axis direction of said rotatable heat generating member among the recording materials usable by said image heating apparatus, is passed through said image heating apparatus.

4. A apparatus according to claim 1, wherein said first magnetic flux blocking portion and said second magnetic flux blocking portion are integral with each other and comprise non-magnetic material.

5. A apparatus according to claim 4, wherein said magnetic flux blocking means is disposed between said coil and said heat generating member.

6. A apparatus according to claim 1, wherein said magnetic flux blocking means includes a plate member of an arcuate configuration, and the magnetic flux blocking length is a circumferential length measured along the arcuate configuration.

7. A apparatus according to claim 1, wherein said magnetic flux blocking means is a plate member of a straight configuration.

8. A apparatus according to claim 1, wherein a step is provided between said first magnetic flux blocking portion and said second magnetic flux blocking portion.

* * * * *

UNITED STATES PATENT AND TRADEMARK OFFICE

CERTIFICATE OF CORRECTION

PATENT NO. : 7,268,327 B2
APPLICATION NO. : 11/255035
DATED : September 11, 2007
INVENTOR(S) : Naoyuki Yamamoto et al.

It is certified that error appears in the above-identified patent and that said Letters Patent is hereby corrected as shown below:

COLUMN 1
Line 60, “term” should read --terms--.

COLUMN 2
Line 2, “small” should read --smaller--.
Line 20, “comprises:” should read --comprise:--.
Line 22, “induction:” should read --induction;--.

COLUMN 3
Line 36, “apace” should read --space--.
Line 42, “On” should read --On the--.

COLUMN 4
Line 42, “according” should read --according to--.

COLUMN 5
Line 55, “Or” should read --OF--.

COLUMN 7
Line 65, “Fe.” should read --Fe,--.

COLUMN 10
Line 12, “effected,” should read --effected.--.

COLUMN 11
Line 18, “conveyed:” should read --conveyed,--.
Line 21, “Is” should read --is--.

UNITED STATES PATENT AND TRADEMARK OFFICE

CERTIFICATE OF CORRECTION

PATENT NO. : 7,268,327 B2
APPLICATION NO. : 11/255035
DATED : September 11, 2007
INVENTOR(S) : Naoyuki Yamamoto et al.

It is certified that error appears in the above-identified patent and that said Letters Patent is hereby corrected as shown below:

COLUMN 14
Line 36, "DM," should read --Dm,--.

COLUMN 17
Line 62, "potions" should read --portions--.
Line 64, "is" should be deleted.

COLUMN 20
Line 1, "is" should be deleted

COLUMN 21
Line 53, "A" should read --An--.

COLUMN 22
Line 22, "A" should read --An--.
Line 30, "A" should read --An--.
Line 37, "A" should read --An--.
Line 41, "A" should read --An--.
Line 45, "A" should read --An--.
Line 50, "A" should read --An--.
Line 53, "A" should read --An--.

Signed and Sealed this

Twenty-fourth Day of June, 2008

JON W. DUDAS
*Director of the United States Patent and Trademark Office*